US006143971A

United States Patent [19]

Aoki et al.

[11] Patent Number: 6,143,971

[45] Date of Patent: Nov. 7, 2000

[54] AUTOMATIC COMPOSITION APPARATUS AND METHOD, AND STORAGE MEDIUM

[75] Inventors: Eiichiro Aoki; Toshio Sugiura, both of Hamamatsu, Japan

[73] Assignee: Yamaha Corporation, Japan

[21] Appl. No.: 09/392,799

[22] Filed: Sep. 9, 1999

[30] Foreign Application Priority Data

Sep. 9, 1998 [JP] Japan ..... 10-255450

[51] Int. Cl.[7] ..... G10H 7/00

[52] U.S. Cl. ..... 84/609; 84/610; 84/634

[58] Field of Search ..... 84/600, 601–602, 84/604, 609–614, 634–637, 649–652, 666–669

[56] References Cited

U.S. PATENT DOCUMENTS

| | | | |
|---|---|---|---|
| 5,375,501 | 12/1994 | Okuda | 84/611 |
| 5,451,709 | 9/1995 | Minamitaka | 84/609 |
| 5,484,957 | 1/1996 | Aoki et al. | 84/635 |
| 5,510,572 | 4/1996 | Hayashi et al. | 84/609 |
| 5,705,761 | 1/1998 | Minamitaka | 84/609 |
| 5,736,663 | 4/1998 | Aoki et al. | 84/609 |

FOREIGN PATENT DOCUMENTS 9-50278 2/1997 Japan .

*Primary Examiner*—David Martin
*Assistant Examiner*—Marlon Fletcher
*Attorney, Agent, or Firm*—Rossi & Associates

[57] ABSTRACT

An automatic composition apparatus is provided which enables the user to compose a piece of music while taking account of the overall structure of the melody of the piece of music as a whole. A CPU generates each of a plurality of layers of skeleton that constitutes a melody of a piece of music. The plurality of layers form a hierarchical structure formed preferably of a layer of an overall skeleton, a layer of an passage skeleton based on the overall skeleton, and a phrase skeleton based on the passage skeleton. The CPU generates each layer of skeleton except the highest layer of skeleton, based on at least one of the plurality of layers of skeleton that is higher than the each layer of skeleton.

25 Claims, 24 Drawing Sheets

FIG.4A

| PASSAGE | 1 | 2 | 3 | 4 | 5 | 6 | 7 | 8 |
|---|---|---|---|---|---|---|---|---|
| SYMBOL | A | A' | A" | A | B | C | A' | A" |

FIG.4B

| | | SAME-NAME PASSAGE | 1ST TYPE SIMILAR PASSAGE | 2ND TYPE SIMILAR PASSAGE |
|---|---|---|---|---|
| OVERALL SKELETON | MOTION PATTERN | SAME | × | × |
| | NODE PITCH | SAME | THE SAME FIRST PITCH OF PASSAGE | × |
| PASSAGE SKELETON | MOTION PATTERN | SAME | SIMILAR | SIMILAR |
| | NODE PITCH | SAME | AT LEAST THE FIRST PHRASE IS THE SAME | × |
| PHRASE SKELETON | MOTION PATTERN | SAME (SIMILAR WHEN THE NUMBER OF SYLLABLES IS DIFFERENT) | SAME (SIMILAR WHEN THE NUMBER OF SYLLABLES IS DIFFERENT) | SIMILAR |
| | NODE PITCH | SAME (SIMILAR WHEN THE NUMBER OF SYLLABLES IS DIFFERENT) | SAME (SIMILAR WHEN THE NUMBER OF SYLLABLES IS DIFFERENT) | × |

| PASSAGE | 1ST PASSAGE [A] | | | 2ND PASSAGE [A'] | | | 3RD PASSAGE [B] | | | 4TH PASSAGE [C] | | |
|---|---|---|---|---|---|---|---|---|---|---|---|---|
| SECTION | 1 | 2 | 3 | 1 | 2 | 3 | 1 | 2 | 3 | 1 | 2 | 3 |
| MOTION PATTERN | DOWNWARD | UPWARD | UPWARD | DOWNWARD | UPWARD | DOWNWARD | DOWNWARD | UPWARD | DOWNWARD | DOWNWARD | HORIZONTAL | DOWNWARD |

| PASSAGE | 1ST PASSAGE | | | | | | 2ND PASSAGE | | | | | |
|---|---|---|---|---|---|---|---|---|---|---|---|---|
| SECTION | 1ST PHRASE | | | 2ND PHRASE | | | 1ST PHRASE | | | 2ND PHRASE | | |
| SECTION | 1 | 2 | 3 | 1 | 2 | 3 | 1 | 2 | 3 | 1 | 2 | 3 |
| MOTION PATTERN | UW | DW | DW | UW | DW | H | UW | DW | DW | UW | DW | H |

| 3RD PASSAGE | | | | | | 4TH PASSAGE | | | | | |
|---|---|---|---|---|---|---|---|---|---|---|---|
| 1ST PHRASE | | | 2ND PHRASE | | | 1ST PHRASE | | | 2ND PHRASE | | |
| 1 | 2 | 3 | 1 | 2 | 3 | 1 | 2 | 3 | 1 | 2 | 3 |
| H | H | DW | DW | DW | H | UW | UW | DW | UW | DW | H |

UW : UP-WARD DW : DOWN-WARD H : HORIZONTAL

AUTOMATIC COMPOSITION APPARATUS AND METHOD, AND STORAGE MEDIUM

BACKGROUND OF THE INVENTION

1. Field of the Invention

The present invention relates to automatic composition apparatus and method for automatically composing a piece of music according to various conditions relating to music, and a storage medium that stores an automatic composition program.

2. Prior Art

A known automatic composition apparatus for automatically composing a piece of music according to various conditions relating to music is disclosed in, for example, laid-open Japanese Patent Publication (Kokai) No. 9-50278 and corresponding U.S. Pat. No. 5,736,663.

The automatic composition apparatus disclosed in the above-identified publication or U.S. Patent is adapted to analyze and extract musical features of an already-composed piece of music, and store the results of the analyzing and extracting process as a music template into a performance data memory. The known apparatus enables the user to suitably modify a music template selected from various music templates stored in the memory, to thereby automatically compose a piece of music based on the template that has been modified.

The data contained in the music template includes "emotional fluctuations" set for the whole piece of music, "pitch pattern" set for each phrase, and others, which enable the user to sense the atmosphere of a melody generated according to the music template. The music template also contains data that designate pitches of the first and last syllables of each phrase. When determining pitches of each phrase, therefore, the known apparatus initially determines the first and last pitches of the phrase in question, and then determines the remaining pitches of the phrase in question. If the "pitch pattern" or "data designating the first and last syllables" are not designated for the phrase in question, its pitches are determined according to the "emotional fluctuations" as indicated above.

In the known automatic composition apparatus as described above, the music template contains data represented by abstract or nonobjective expressions such as "emotional fluctuations", and therefore the user cannot tell from the music template what changes of pitches are imparted to a melody that will be generated. Also, since the known apparatus uses such data as "pitch pattern" for each phrase, without taking account of the relationship between those of adjacent phrases, it is difficult for the user to visually grasp changes of pitches over the piece of music as a whole.

In FIG. 6 of the above-identified publication, for example, a "horizontal→downward" curve is set as the "emotional fluctuation" of passage A, whereas "downward→horizontal→upward" arrows are set as the "pitch pattern" of the same passage A. Thus, different changes in the pitch level are obtained based on the two types of data.

In the known automatic composition apparatus as described above, the first and last pitches of each phrase are initially determined based on the "data designating the first and last syllables", and it is therefore difficult for the user to compose a piece of music while considering the whole structure of the music piece. It is possible to compose a piece of music in view of the whole structure of the music piece based on the "emotional fluctuations", if the "pitch pattern" and "data designating the first and last syllables" are not designated for the phrase. If the "pitch pattern" and/or "data designating the first and last syllables" are designated later, however, the resulting pitch changes in the phrase in question may differ from those obtained based on the "emotional fluctuations".

When the user listens to and evaluates a melody of a piece of music composed in the above manner, the known automatic composition apparatus as described above only permits the user to listen to the melody that is played back from the beginning to the end thereof, resulting in an increased time required for evaluation.

SUMMARY OF THE INVENTION

It is the first object of the present invention to provide automatic composition apparatus and method, and a storage medium, which enables the user to compose a piece of music while taking account of the overall structure of the melody of the piece of music as a whole.

It is the second object of the present invention to provide an automatic composition apparatus and method, and a storage medium, which enables the user to visually grasp pitch changes over the entire piece of music.

It is the third object of the present invention to provide automatic composition apparatus and method, and a storage medium, which enables the user to immediately evaluate the melody of the composed music piece.

To accomplish the first object as indicated above, the present invention provides an automatic composition apparatus comprising a generating device that generates each of a plurality of layers of skeleton that constitutes a melody of a piece of music, the plurality of layers forming a hierarchical structure, wherein the generating device generates each layer of skeleton except the highest layer of skeleton, based on at least one of the plurality of layers of skeleton that is higher than the each layer of skeleton.

To accomplish the first object as indicated above, the present invention also provides an automatic composition apparatus comprising a generating device that generates each of a plurality of layers of skeleton that constitutes a melody of a piece of music, the plurality of layers forming a hierarchical structure, wherein the generating device generates each layer of skeleton except the highest layer of skeleton among the plurality of layers of skeleton, by modifying only the each layer of skeleton without modifying at least one of the plurality of layers of skeleton that is higher than the each layer.

To accomplish the first object as indicated above, the present invention also provides an automatic composition apparatus comprising a generating device that generates each of a plurality of layers of skeleton that constitutes a melody of a piece of music, the plurality of layers forming a hierarchical structure, wherein the generating device first generates the highest layer of skeleton among the plurality of layers of skeleton, and then generates each of at least one other layer of skeleton than the highest layer of skeleton, based on at least one of the plurality of layers of skeleton that is higher than the each of at least one other layer of skeleton.

Preferably, the plurality of layers of skeleton comprise a layer of an overall skeleton, a layer of an passage skeleton based on the overall skeleton, and a phrase skeleton based on the passage skeleton.

To accomplish the first object as indicated above, the present invention further provides an automatic composition apparatus comprising a generating device that generates a skeleton that constitutes a melody of a piece of music, and a setting device that divides the piece of music into a plurality of sequential regions of a predetermined category, and sets each of the regions to one of a new musical component, the same musical component that is identical with a musical component set in a preceding one of the plurality of sequential regions, and a similar musical component that is similar to a musical component set in a preceding one of the plurality of sequential regions, wherein the generating device generates a skeleton of the region set to the same or similar musical component by the setting device, based on a skeleton of the preceding one of the plurality of sequential regions.

Preferably, the generating device generates the skeleton of the region set to the same musical component by the setting device, that is the same as the skeleton of the preceding one of the plurality of sequential regions.

Also preferably, the generating device generates the skeleton of the region set to the similar musical component by the setting device, that has only a portion thereof identical with the skeleton of the preceding one of the plurality of sequential regions.

Preferably, the generating device generates a portion of the skeleton of the region set to the similar musical component by the setting device other than the portion of the skeleton that is identical with the skeleton of the preceding one of the plurality of sequential regions, using at least one of constituent notes of a given chord.

Preferably, the generating device generates the skeleton of the region set to the new musical component, using at least one of constituent notes of a given chord.

To accomplish the first object as indicated above, the present invention also provides a method of automatically composing a piece of music, comprising a step of generating each of a plurality of layers of skeleton that constitutes a melody of a piece of music, the plurality of layers forming a hierarchical structure, wherein each layer of skeleton except the highest layer of skeleton is generated based on at least one of the plurality of layers of skeleton that is higher than the each layer of skeleton.

To accomplish the first object as indicated above, the present invention also provides a method of automatically composing a piece of music, comprising a step of generating each of a plurality of layers of skeleton that constitutes a melody of a piece of music, the plurality of layers forming a hierarchical structure, wherein each layer of skeleton except the highest layer of skeleton among the plurality of layers of skeleton is generated by modifying only the each layer of skeleton without modifying at least one of the plurality of layers of skeleton that is higher than the each layer.

To accomplish the first object as indicated above, the present invention also provides a method of automatically composing a piece of music, comprising a step of generating each of a plurality of layers of skeleton that constitutes a melody of a piece of music, the plurality of layers forming a hierarchical structure, wherein the highest layer of skeleton among the plurality of layers of skeleton is first generated, and then each of at least one other layer of skeleton than the highest layer of skeleton is generated based on at least one of the plurality of layers of skeleton that is higher than the each of at least one other layer of skeleton.

To accomplish the first object as indicated above, the present invention also provides a method of automatically composing a piece of music, comprising steps of generating a skeleton that constitutes a melody of a piece of music, dividing the piece of music into a plurality of sequential regions of a predetermined category, and setting each of the regions to one of a new musical component, the same musical component that is identical with a musical component set in a preceding one of the plurality of sequential regions, and a similar musical component that is similar to a musical component set in a preceding one of the plurality of sequential regions, wherein a skeleton of the region set to the same or similar musical component by the setting step is generated based on a skeleton of the preceding one of the plurality of sequential regions.

To accomplish the first object as indicated above, the present invention further provides a storage medium storing an automatic composition program that is executable by a computer, the program comprising a generating module that generates each of a plurality of layers of skeleton that constitutes a melody of a piece of music, the plurality of layers forming a hierarchical structure, wherein the generating module generates each layer of skeleton except the highest layer of skeleton, based on at least one of the plurality of layers of skeleton that is higher than the each layer of skeleton, a storage medium storing an automatic composition program that is executable by a computer, the program comprising a generating module that generates each of a plurality of layers of skeleton that constitutes a melody of a piece of music, the plurality of layers forming a hierarchical structure, wherein each layer of skeleton except the highest layer of skeleton among the plurality of layers of skeleton is generated by modifying only the each layer of skeleton without modifying at least one of the plurality of layers of skeleton that is higher than the each layer, and a storage medium storing an automatic composition program that is executable by a computer, the program comprising a generating module that generates each of a plurality of layers of skeleton that constitutes a melody of a piece of music, the plurality of layers forming a hierarchical structure, wherein the highest layer of skeleton among the plurality of layers of skeleton is first generated, and then each of at least one other layer of skeleton than the highest layer of skeleton is generated based on at least one of the plurality of layers of skeleton that is higher than the each of at least one other layer of skeleton.

To accomplish the first object as indicated above, the present invention further provides a storage medium storing an automatic composition program that is executable by a computer, said program comprising a generating module that generates a skeleton that constitutes a melody of a piece of music, a dividing module that divides the piece of music into a plurality of sequential regions of a predetermined category, and a setting module that sets each of the regions to one of a new musical component, the same musical component that is identical with a musical component set in a preceding one of the plurality of sequential regions, and a similar musical component that is similar to a musical component set in a preceding one of the plurality of sequential regions, wherein a skeleton of the region set to the same or similar musical component by said setting module is generated based on a skeleton of said preceding one of the plurality of sequential regions.

To accomplish the second object as indicated above, the present invention provides an automatic composition apparatus comprising a generating device that generates each of a plurality of layers of skeleton that constitutes a melody of a piece of music, the plurality of layers forming a hierarchical structure, and a display device that displays the plurality of layers of skeleton generated by the generating device, at the same time.

To accomplish the second object as indicated above, the present inventionn also provides a method of automatically composing a piece of music, comprising steps of generating each of a plurality of layers of skeleton that constitutes a melody of a piece of music, the plurality of layers forming a hierarchical structure, and displaying the plurality of layers of skeleton generated by the generating step, at the same time, and a storage medium storing an automatic composition program that is executable by a computer, the program comprising a generating module that generates each of a plurality of layers of skeleton that constitutes a melody of a piece of music, the plurality of layers forming a hierarchical structure, and a display module that displays the plurality of layers of skeleton generated by the generating module, at the same time.

To attain the third object as indicated above, the present invention provides an automatic composition apparatus comprising a generating device that generates each of a plurality of layers of skeleton that constitutes a melody of a piece of music, the plurality of layers forming a hierarchical structure, and a playback device that plays a selected one of the plurality of layers of skeleton generated by the generating device.

To attain the third object as indicated above, the present invention also provides a method of automatically composing a piece of music, comprising steps of generating each of a plurality of layers of skeleton that constitutes a melody of a piece of music, the plurality of layers forming a hierarchical structure, and playing a selected one of the plurality of layers of skeleton generated by the generating step, and a storage medium storing an automatic composition program that is executable by a computer, the program comprising a generating module that generates each of a plurality of layers of skeleton that constitutes a melody of a piece of music, the plurality of layers forming a hierarchical structure, and a playback module that plays a selected one of the plurality of layers of skeleton generated by the generating module.

The above and other objects of the invention will become more apparent from the following drawings taken in conjunction with the accompanying drawings.

BRIEF DESCRIPTION OF THE DRAWINGS

FIGS. 4A and 4B are views useful in explaining the meaning of passage symbols set to passages;

DETAILED DESCRIPTION OF THE PREFERRED EMBODIMENT

One preferred embodiment of the present invention will be described in detail with reference to the accompanying drawings.

Figure 1:
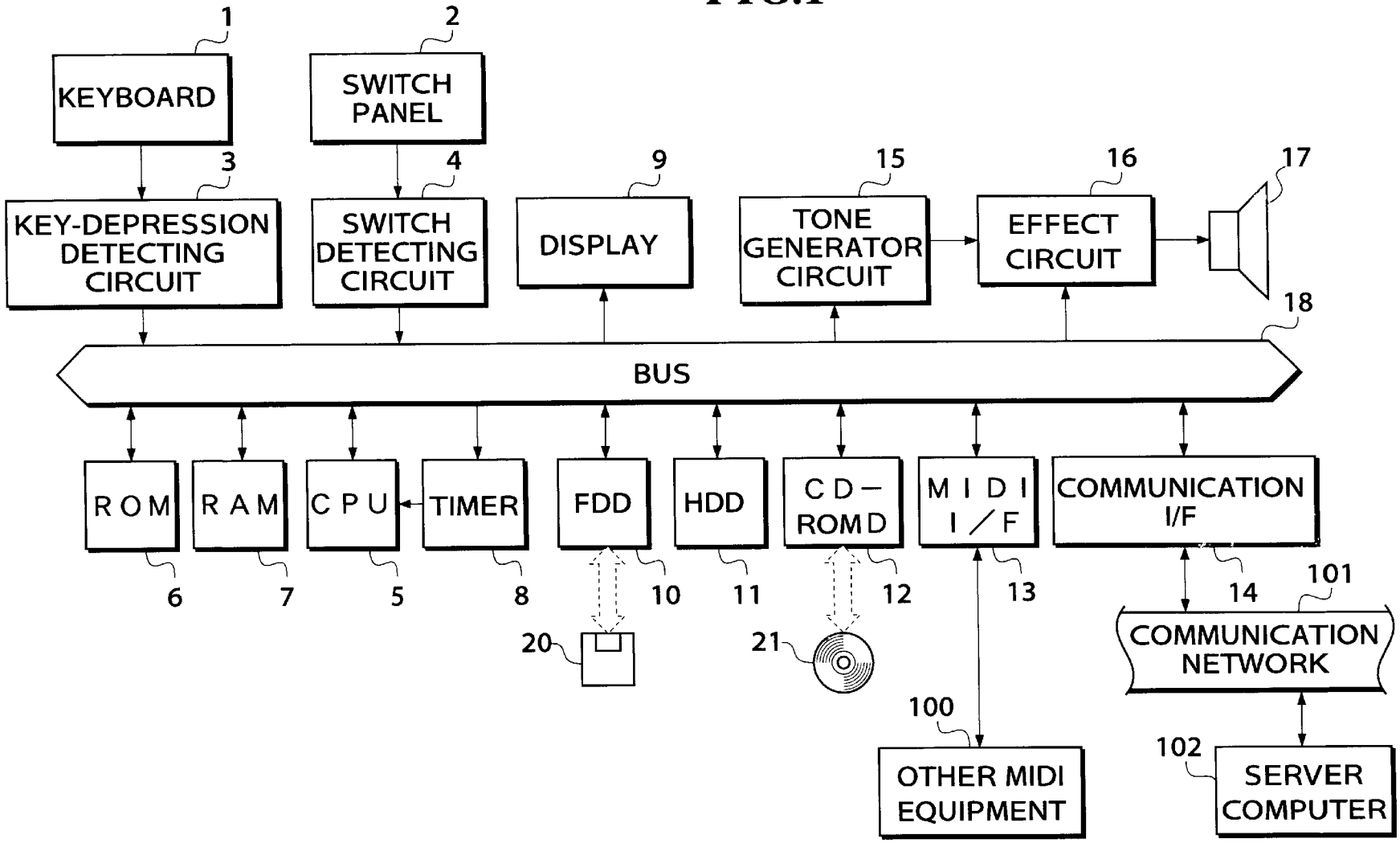
FIG. 1 is a block diagram schematically showing the construction of an automatic composition apparatus according to one embodiment of the present invention.

FIG. 1 is a block diagram schematically showing the construction of an automatic composition apparatus according to one embodiment of the present invention.

As shown in FIG. 1, the automatic composition apparatus of the present embodiment includes a keyboard 1 through which pitch information is entered, a switch panel 2 including a plurality of switches with which various types of information is entered, a key-depression detecting circuit 3 that detects the operated state of each key on the keyboard 1, and a switch detecting circuit 4 that detects the operated or depressed state of each switch on the switch panel 2. The automatic composition apparatus also includes CPU 5 that governs control of the whole apparatus, ROM 6 that stores control programs to be executed by the CPU 5, table data, and so forth, RAM 7 that temporarily stores performance data, various input information, and operation results, and a timer 8 that counts interrupt time during timer interrupt processing, and various periods of time. The present apparatus further includes a display device 9 for displaying various information, which includes, for example, a large-sized liquid crystal display (LCD) or CRT (cathode ray tube) display, and light emitting diodes (LED), a floppy disc drive (FDD) 10 for driving a floppy disc (FD) 20 as one type of storage medium, a hard disc drive (HDD) 11 for driving a hard disc (not shown) that may store various application programs including the above control programs, and various types of data, and a CD-ROM drive (CD-ROMD) 12 for driving a CD-ROM (compact disc-read only memory) 21 that may store various application programs including the above control programs, and various types of data. The apparatus further includes a MIDI interface (I/F) 13 that receives MIDI (Musical Instrument Digital Interface) signals from external devices or equipment, and generates MIDI signals to the external devices or equipment, a communication interface (I/F) 14 that transmits and receives data to and from a server computer 102, or the like, through a communication network 101, a tone generator circuit 15 that converts performance data entered through the keyboard 1, preset performance data, or the like, into musical tone signals, an effect circuit 16 that gives various sound effects to the tone signals received from the tone source circuit 15, and a sound system 17 that converts the tone signals received from the effect circuit 16, into actual sound. The sound system 17 may consist of a DAC (Digital-to-Analog Converter), an amplifier, a loudspeaker, or the like.

In the apparatus of the present embodiment, the components 3–16 as indicated above are connected with each other via a bus 18. In addition, the timer 8 is connected to the CPU 5, and other MIDI equipment 100 is connected to the MIDI I/F 13, while the communication network 101 is connected to the communication I/F 14. Also, the effect circuit 16 is connected to the tone generator circuit 15, and the sound system 17 is connected to the effect circuit 16.

As described above, the hard disc mounted in the HDD 11 may store control programs to be executed by the CPU 5. Where a certain control program is not stored in the ROM 6, the hard disc may store the control program, which is read into the RAM 7 so that the CPU 5 can perform the same operation as in the case where the control program is stored in the ROM 6. In this manner, a new control program can be easily added, or an existing program that has been already installed can be easily upgraded.

A control program or various data may be read from the CD-ROM 21 set in the CD-ROM drive 12, and stored to the hard disc in the HDD 11. In this manner, a new control program can be easily installed, or an existing program can be easily upgraded. The present apparatus may be provided with other external storage devices, such as a magneto-optic disc (MO) device, that utilize various forms of storage media, in addition to or in place of the CD-ROM device 12.

As described above, the communication I/F 14 is connected to the communication network 101, such as LAN (Local Area Network), Internet, or a telephone line, so as to be connected to the server computer 102 via the communication network 101. In the case where a certain program or a certain set of parameters is not stored in the hard disc within the HDD 11, the communication I/F 14 may be used for downloading the program or parameters from the server computer 102. A client computer (i.e., automatic composition apparatus in the present embodiment) sends a command to the server computer 102 via the communication I/F 14 and communication network 101, to request downloading of a desired program or parameters. Upon receipt of the command, the server computer 102 delivers the requested program or set of parameters to the client computer, through the communication network 101. The client computer then receives the program or set of parameters through the communication I/F 14, and stores the same to the hard disc in the HDD 11. In this manner, downloading is accomplished.

It is also possible to provide another interface for transmitting and receiving data directly to and from an external computer, or the like.

Figure 2:
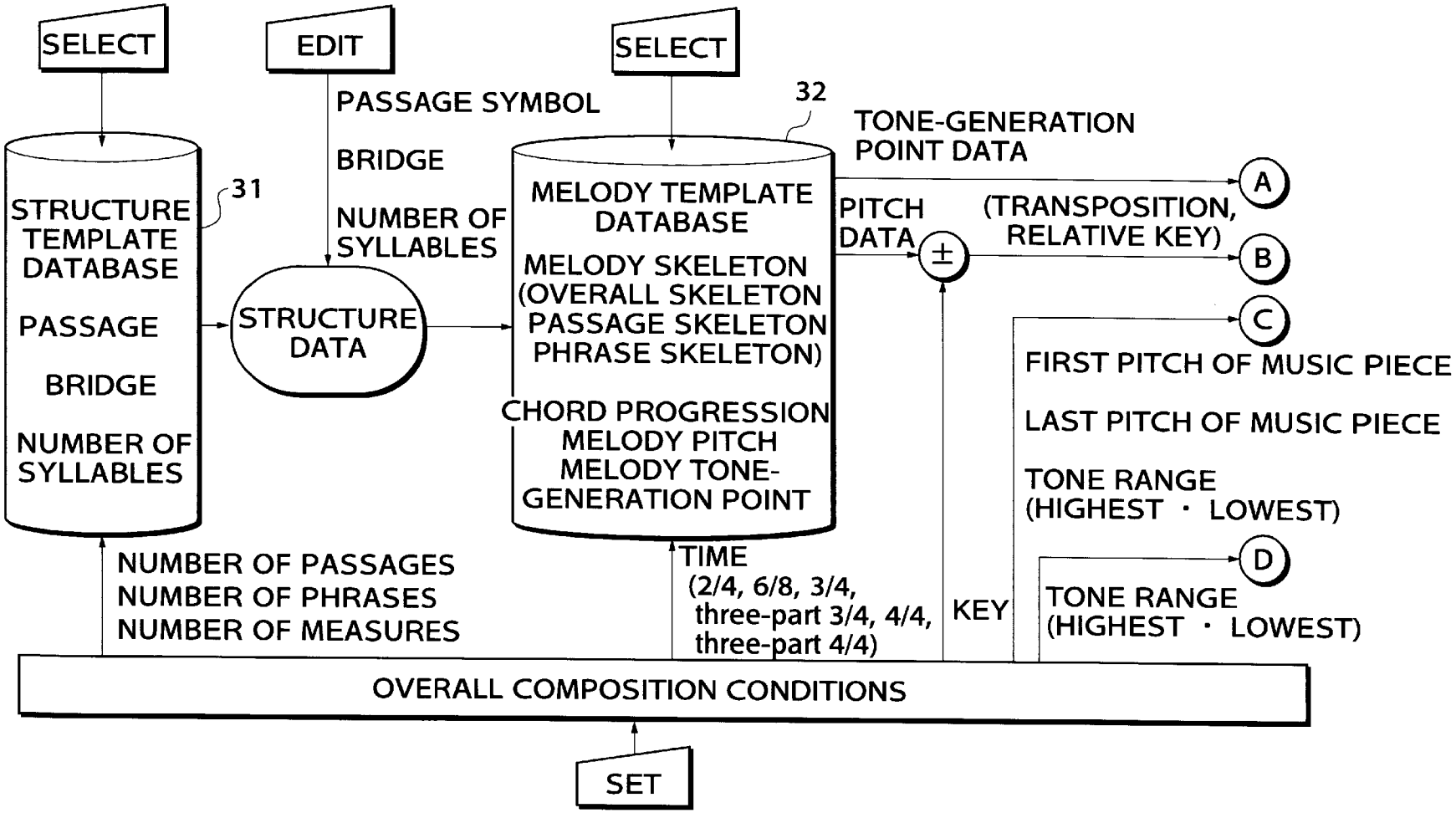
FIG. 2 is a view visually representing control operations performed by the automatic composition apparatus of FIG. 1.
Figure 3:
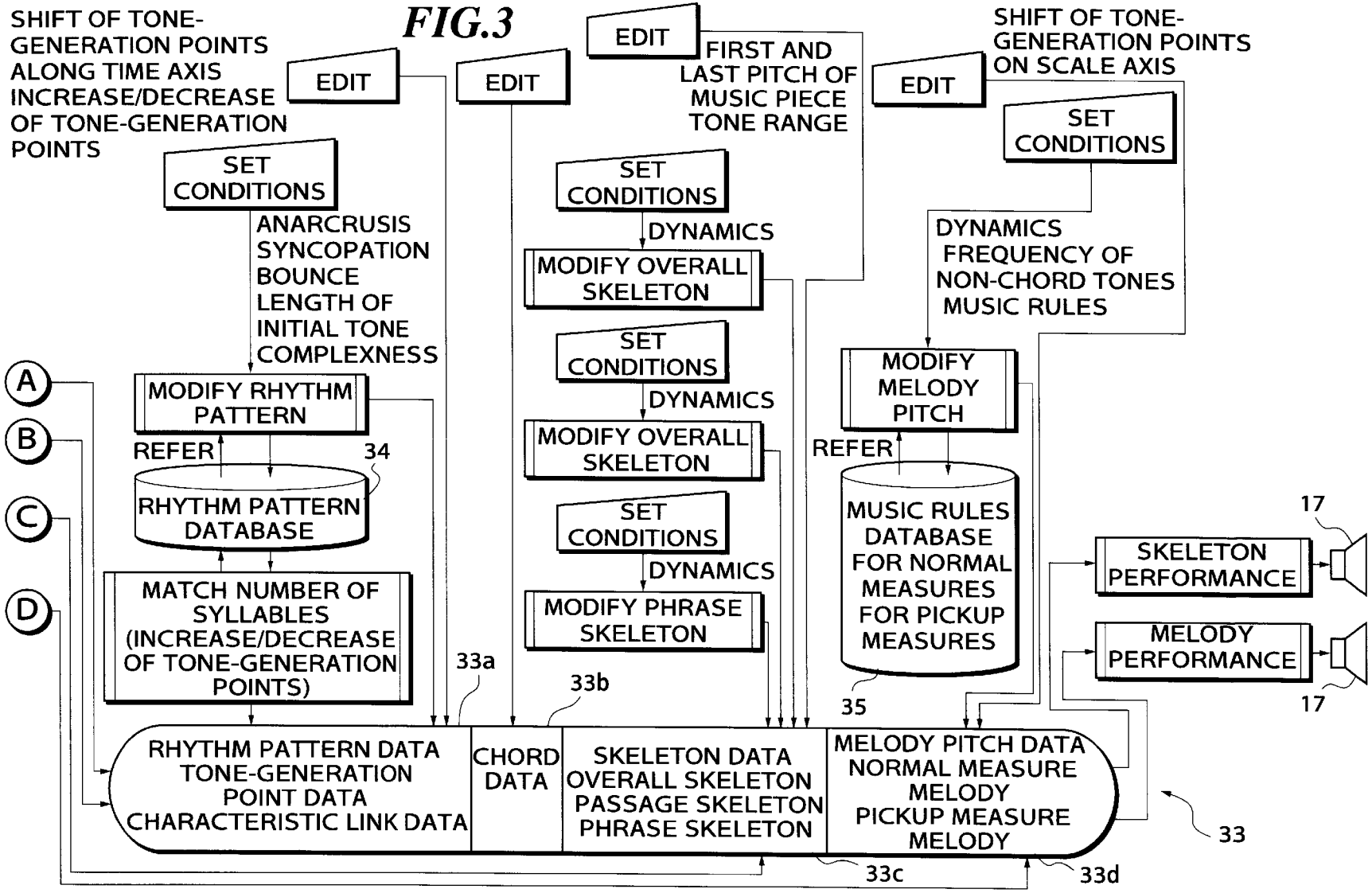
FIG. 3 is a view visually representing remaining parts of the control operations performed by the automatic composition apparatus of FIG. 1.

FIG. 2 and FIG. 3 visually represent various control operations performed by the automatic composition apparatus of the present embodiment. Referring to FIGS. 2 and 3, the summary of the control operations will be described.

In FIG. 2, the user initially selects one from a plurality of templates each containing a set of overall composition conditions, to thereby set (enter) a desired set of overall composition conditions contained in the selected template. Items to be set as the overall composition conditions include, for example, the number of passages, the number of phrases, time or meter, key, the first pitch of a piece of music, the last pitch of the music piece, the tone range (defined by the highest tone and the lowest tone), and so forth. Data corresponding to these items are prescribed in advance in each of the templates to which a certain name is given. If the user selects a mode for selecting the overall composition conditions, and clicks a column of "overall composition conditions" that is displayed in this mode, a pop-up menu listing the names of the templates appears on the display. If the user selects a desired one of the template names, the overall composition conditions contained in the template corresponding to the selected name are established. It is, however, to be noted that the items of the composition conditions may be individually modified or entered by the user.

Based on the number of passages, the number of phrases and the number of measures, among the overall composition conditions established in the above manner, a structure template that best matches the above conditions is selected or retrieved from a structure template database 31, or a plurality of structure templates matching the above conditions are presented to the user, thus allowing the user to select one of these templates. Here, the structure template database 31 is a database constructed on the hard disc, and consists of a plurality of structure templates. Structure data contained in each structure template include, for example, a passage symbol (as shown in FIG. 4A) set for each passage, the position of a bridge passage, the number of syllables, and so on. If the structure data of the structure template retrieved from the structure template database 31 is different from the one desired by the user, the user may select a desired one from other candidates, or edit a part of the structure data of the structure temperate thus retrieved.

A melody template database 32 is then searched based on the thus generated structure data (except the number of syllables) and the time or meter set as one of the overall composition conditions, and a melody template that best matches these conditions is retrieved from the database 32. The melody template database 32 may be constructed on the hard disc, like the structure template database 31, and consists of a plurality of melody templates. Each melody template contains data of each of items including a melody skeleton (that consists of an overall skeleton as the uppermost layer, a passage skeleton as the intermediate layer, and a phrase skeleton as the lowest layer, in the hierarchical structure of the present embodiment), chord progression, pitches and tone-generating points of a melody. The data contained in each melody template is sufficient as it is (without being modified as described later) for performance of a piece of music. If a certain melody template is retrieved from the melody template database 32 as described above, each piece of data contained in the melody template is established (entered). If the selected melody template is different from the one desired by the user, a desired one may be selected from other candidates, as in the case of the structure template.

Once each data contained in the melody template has been entered, pitch data among the data entered is converted into that of a transposed key or relative key, according to the key that was set as one of the overall composition conditions, and the resulting pitch data is supplied to a melody template modifying unit 33 of FIG. 3. The data other than the pitch data are supplied to the melody template modifying unit 33 without being converted.

As shown in FIG. 3, the melody template modifying unit 33 consists of a rhythm pattern data modifying unit 33*a*, a chord data modifying unit 33*b*, a skeleton data modifying unit 33*c*, and a melody pitch data modifying unit 33*d*.

Where the rhythm pattern in the selected melody template is different from that as desired or intended by the user, the rhythm pattern data modifying unit 33*a* generates a rhythm pattern characteristic link table and new tone-generation point data (rhythm pattern data), based on various conditions set by the user, including items such as the presence of anacrusis (unstressed note), the presence of syncopation, the presence of bounce (dotted note), the length of the initial note, and the level of complexness (easiness/difficulty). The rhythm pattern characteristic link table is constructed by setting data relating to each of the above items, namely, rhythm pattern characteristics, for each measure, and linking a series of the set data over the entire piece of music. The tone-generation point represents a point of time at which a tone of a melody is generated, and the number of tone-generating points in one measure corresponds to the number of syllables in the same measure. Based on each characteristic link data in the rhythm pattern characteristic link table, a rhythm pattern for one measure is retrieved from a rhythm pattern database 34. Then, rhythm pattern data of the whole piece of music is generated by linking or connecting the rhythm patterns of all of the measures in the piece of music in question.

Also, matching of the number of syllables is performed when the number of syllables set by the user is different from the number of the tone-generation points in the selected melody template (this situation takes place since the information on the number of syllables is not referred to for the retrieval of the melody template), or where the number of syllables set by the user is different from the number of tone-generation points in the rhythm pattern data of the whole piece of music generated as described above. For matching of the number of syllables, a rhythm pattern having the same characteristics as the rhythm pattern in the melody template to be substituted or the rhythm pattern generated as described above but having a different number of syllables is retrieved or selected from the rhythm database 34, so as to effect replacement of the rhythm pattern by the selected one with a result of an increase/decrease in the number of syllables.

The present apparatus is also provided with an edit function that enables the user to perform manual operations for shifting the time axis along which the tone-generation points are distributed, or increasing/decreasing the number of the tone-generation points. If the time axis of the tone-generation points is shifted or the number of these points is changed as a result of a manual operation, the rhythm pattern data modifying unit 33*a* modifies corresponding rhythm pattern data.

The chord data modifying unit 33*b* modifies chord data according to an edit command or instructions of the user, when the chord progression of the selected melody template is different from the one desired by the user.

The skeleton data modifying unit 33*c* performs individual modifying operations with respect to the respective layers of skeleton data contained in the selected melody template, and also performs the overall editing operation with respect to all layers of skeleton data.

The melody pitch data modifying unit 33*d* modifies melody pitch data of the selected melody template, based on dynamics set by the user, the frequency of non-chord tones, and music rules, while referring to a music rule data base 35. If the user generates a command for a scale axis shift of tone-generation points by a manual operation, the melody pitch data modifying unit 33*d* modifies melody pitch data according to the command. Since this modification is individually performed with respect to normal measures and pickup measures in the present embodiment, the music rule data base 35 is constituted by two types of databases for the normal measures and pickup measures, respectively.

In the manner as described above, the rhythm pattern data modifying unit 33*a* modifies rhythm pattern data, and the skeleton data modifying unit 33*c* modifies each skeleton data, i.e., overall skeleton data, passage skeleton data, and phrase skeleton data, while the melody pitch data modifying unit 33*d* modifies melody pitch data of normal measures and melody pitch data of pickup measures, independently of each other. As these modifying operations proceed, the results of the operations (the progress of composition) are displayed on the display device 9.

In addition to the function of reproducing and playing melody pitch data (musical tone data) generated as a result of modification by the melody pitch data modifying unit 33*d*, the automatic composition apparatus of the present embodiment has a function of reproducing and playing musical tone data of each of the three layers of skeleton data generated as a result of modification by the skeleton data modifying unit 33*c*. If the user designates a certain layer of skeleton data and enters a command for performance of this layer of skeleton data, therefore, pitch data (musical tone data) corresponding to the designated skeleton is read out from the skeleton data that has been modified by the skeleton data modifying unit 33*c* and reproduced, and then converted into musical tones by the sound system 17. If the user enters a command for melody performance, on the other hand, pitch data (musical data) corresponding to the desired melody is read out from the melody pitch data that has been modified as described above and reproduced, and then converted into musical tones by the sound system 17.

The present invention is characterized by the skeleton data modifying operation, among the above-described three types of main operations, i.e., rhythm pattern data modifying operation, skeleton data modifying operation and melody pitch data modifying operation, which are performed by the melody template modifying unit 33. The skeleton data modifying operation will be briefly described with reference to FIGS. 4A–B through FIG. 7, and then described in greater detail with reference to FIG. 8 through FIG. 24.

FIGS. 4A–B is a view useful in explaining the meaning of passage symbols set for passages, wherein FIG. 4A shows one example of passage symbols set for respective passages of a certain piece of music, and FIG. 4B shows the contents or meanings of the passage symbols in terms of each skeleton.

A passage symbol is set to each passage of a piece of music. The passage symbol is basically determined by structure data retrieved from the structure template database 31, as described above, but its set value may be changed by the user. FIG. 4A shows one example of passage symbols set for passages in this manner. The example of FIG. 4A contains three types of symbols, namely, those (A') accompanied by "'", those (A") accompanied by "'", and those (A, B, C) that are not accompanied by either "'" or "'". The passages (the first, fifth and sixth passages) to which the last type of passage symbols are given and which do not follow any passage having a passage symbol of the same name are called "new passage", and the passage (the fourth passage) to which the last type of passage symbol is given and which follows a passage having a passage symbol of the same name is called "same-name passage". Also, the passages (the second and seventh passages) to which the first type of passage symbols are given are called "first type similar passage", and the passages (the third and eighth passages) to which the second type of passage symbols are given are called "second type similar passage".

FIG. 4B shows a set of rules according to which the passage of each type is constructed when the passage symbol of each type is set with respect to each skeleton. As described above, the automatic composition apparatus of the present embodiment is constructed so as to generate skeleton data having a hierarchical structure. The hierarchy of this structure consists of the overall skeleton as the uppermost layer, passage skeleton as the middle or intermediate layer, and the phrase skeleton as the lowest layer. Each skeleton is formed by the first pitch and last pitch (each of which will be called "node pitch") in a unit section (each passage in the overall skeleton, each phrase in the passage skeleton, and each measure in the phrase skeleton) set for each layer of skeleton. An operation to sequentially determine the node pitches corresponds to the above-described operation to modify the skeleton data. When each of the node pitches of the passage skeleton and phrase skeleton is determined, in particular, the motion pattern is initially determined, and node pitches are then determined based on the motion pattern. As described later, the last pitch of each of the measures that constitute the phrase skeleton, among the node pitches, does not necessarily coincide with the pitch of the last tone-generation point of the melody generated in the measure in question.

In FIG. 4B, in the case of "the same-name passage", the node pitches of the overall skeleton are determined to be identical with those of "reference passage", namely, a passage of the same or similar name that occurs before the passage in question (for example, the first passage when the passage in question is the fourth passage). In the case of "first type similar passage", the first pitch of the passage in question is determined to be identical with that of the "reference passage" (for example, the first passage when the passage in question is the second passage), and, in the case of "second type similar passage", the node pitches of the passage in question are determined (randomly in the present embodiment) irrespective of those of the "reference passage" (for example, the first passage when the passage in question is the third passage). In FIG. 4B, ""x" represents the last case.

The motion pattern of the passage skeleton is determined as being "identical", "similar", and "similar" with respect to "the same-name passage", "first type similar passage", and "second type similar passage", respectively. The term "similar" is to be interpreted differently from that used in mathematics, and used for a special meaning in the present embodiment. Namely, even if a part of one pattern is not similar (in a mathematical sense) to a corresponding part of the other pattern, these patterns are similar (in a special sense of the present embodiment) to each other provided that the rest of the patterns are similar (in a mathematical sense).

The node pitches of the passage skeleton are determined as being "identical", "identical as of at least the first phrase", and "irrelevant" with respect to "the same-name passage", "first type similar passage", and "second type similar passage", respectively.

The motion pattern and node pitches of the phrase skeleton are also determined in the manner as indicated in FIG. 4B.

Figure 5:
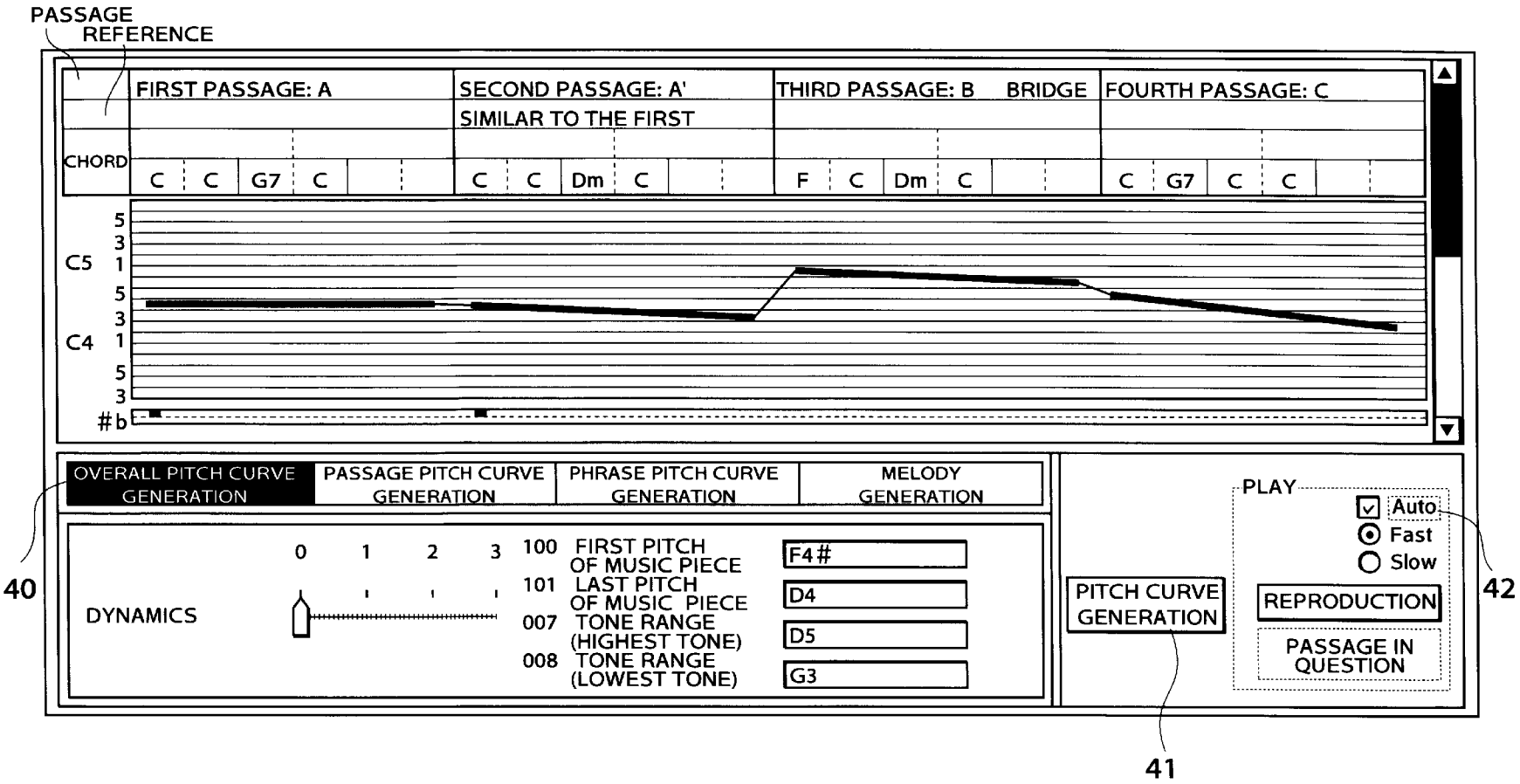
FIG. 5 is a view showing one example of an overall pitch pattern displayed on a display device of FIG. 1.
Figure 6:
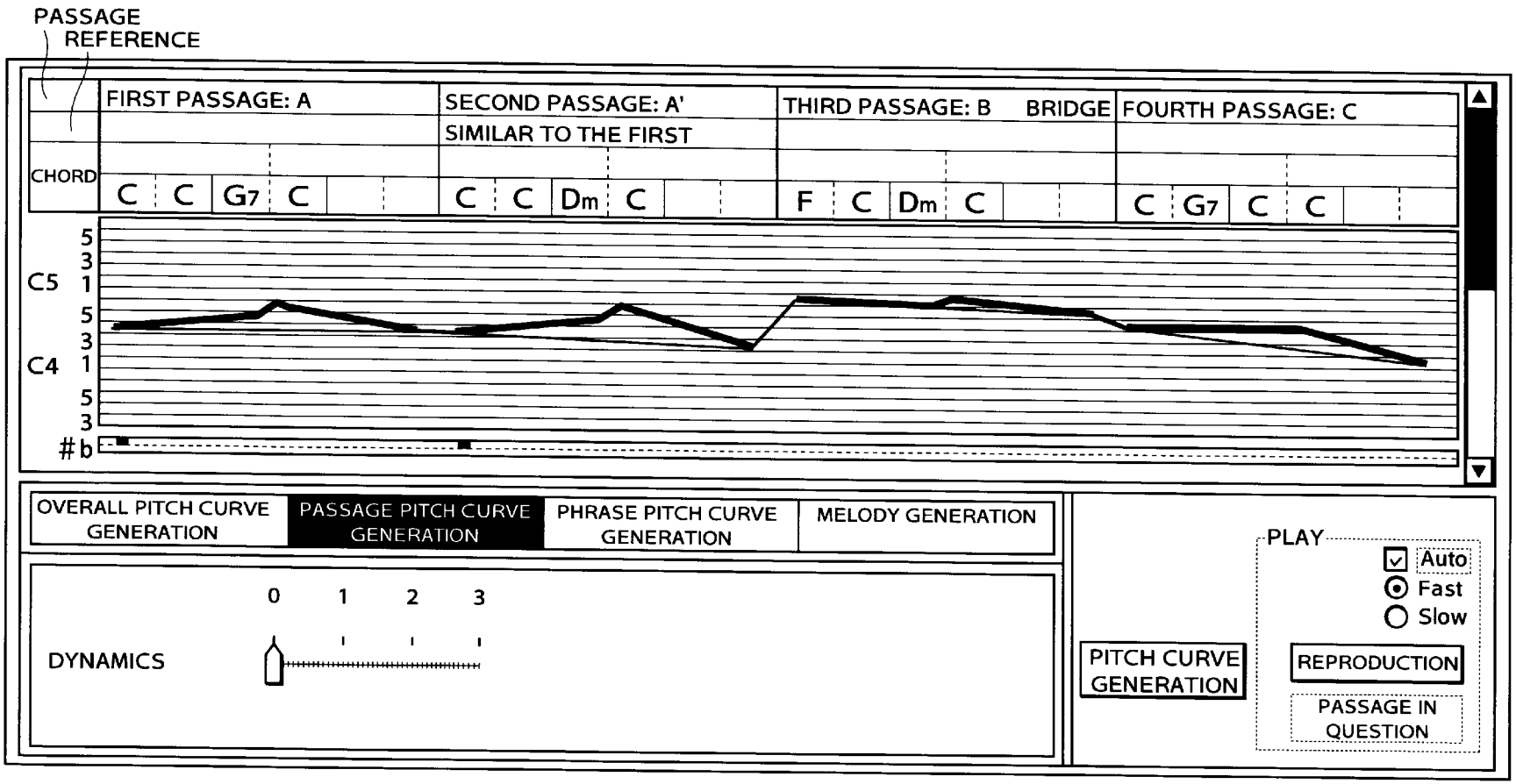
FIG. 6 is a view showing one example of a passage pitch pattern displayed on the display device of FIG. 1.
Figure 7:
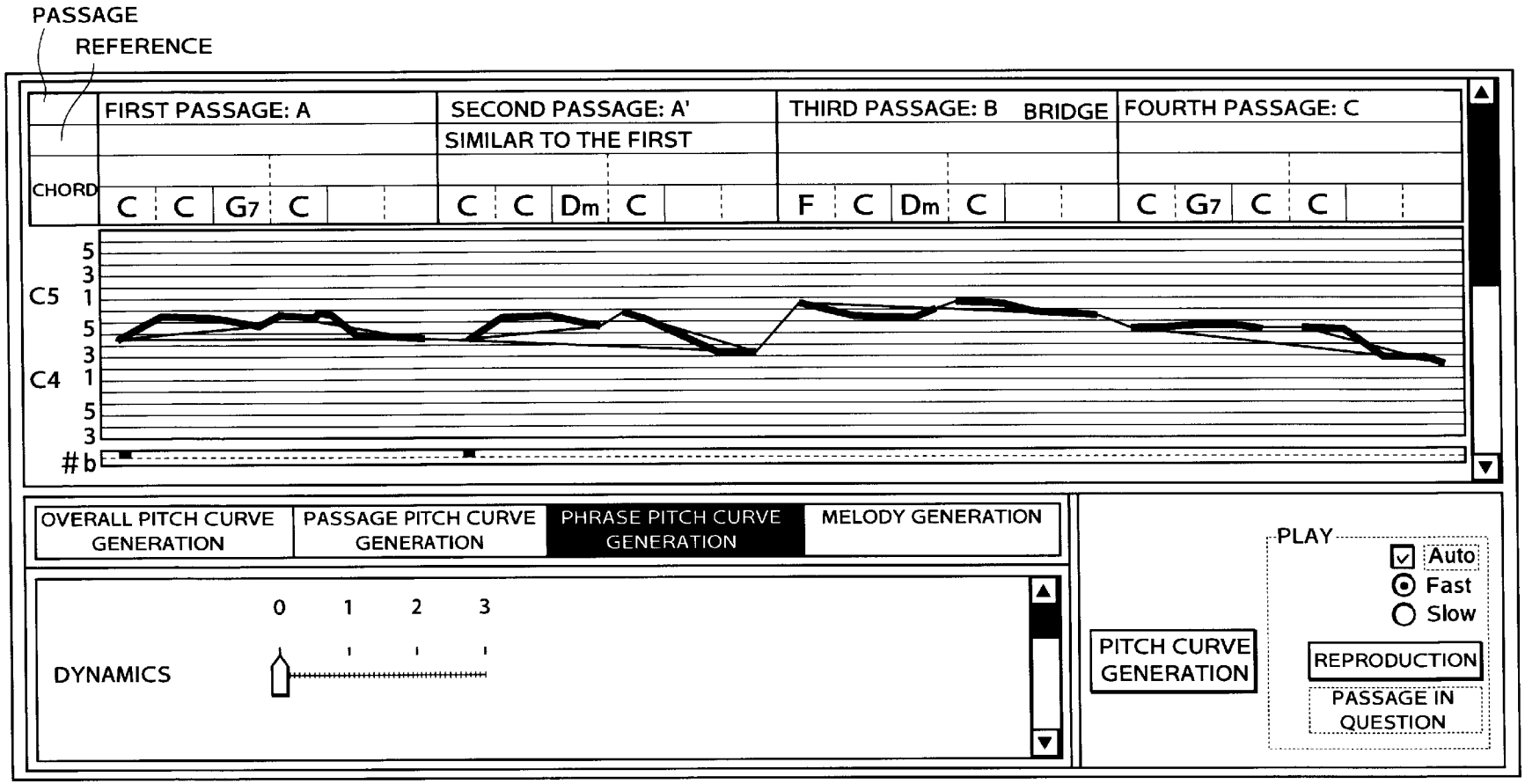
FIG. 7 is a view showing one example of a phrase pitch pattern displayed on the display device of FIG. 1.

Each skeleton data is actually generated according to the rules as described above, and its skeleton (pitch curve) is displayed on the display device 9, as shown in FIG. 5 through FIG. 7. FIG. 5 shows one example in which an overall skeleton is generated and displayed, FIG. 6 shows one example in which a passage skeleton is generated and displayed, while FIG. 7 shows one example in which a phrase skeleton is generated and displayed. It is, however, to be noted that a piece of music shown in FIGS. 5–7 has no relationship with the piece of music explained above with reference to FIG. 4A.

In FIG. 5, the passage symbols "A", "A'", "B", and "C" are set in the first passage to the four passage, respectively. If the user clicks an "overall pitch curve generation" button 40, its display is inverted (the selection of the button 40 is not necessarily represented by the "inversion", but may be represented by a color change, or the like). If a "pitch curve generation" button 41 is then clicked, the overall pitch curve (overall skeleton) is generated according to the rules as described above, and displayed as shown in FIG. 5. At this time, if an "AUTO" button 42 in "PLAY" region is being selected (as indicated by "v" in FIG. 5), pitch data corresponding to the overall skeleton is read out according to the preset tempo and selected speed, and each pitch data is reproduced with a predetermined tone length (for example, quarter note). If "FAST" is being selected as the speed, the pitch data is reproduced at a tempo that is twice the preset tempo, and, if "SLOW" is being selected, the pitch data is reproduced at the preset tempo. If the "AUTO" button is not selected, the pitch curve is played back in the above manner, by clicking a "PLAYBACK" button after the pitch curve is generated.

The example of FIG. 6 is different from that of FIG. 5 in that a passage pitch curve is generated, and the form of display in FIG. 6 is slightly different from that of FIG. 5 due to this difference. In FIG. 6, the passage pitch curve is displayed in addition to the overall pitch curve generated in the example of FIG. 5. To distinguish these two pitch curves from each other, the passage pitch curve is displayed with a thick line for emphasis, while the overall pitch curve is displayed with a normal thin line. Needless to say, the emphasized display is not limited to the use of the thick line, but any display mode may be employed provided that the two types of pitch curves can be distinguished from each other. This also applies to FIG. 7.

FIG. 7 is different from FIG. 5 and FIG. 6 in that a phrase pitch curve is generated, and only the phrase display curve thus generated is displayed with emphasis, while the overall pitch curve and passage pitch curve are displayed in a normal fashion, in a similar manner to FIG. 6.

Next, the skeleton data modifying operation will be described in greater detail.

Figure 8:
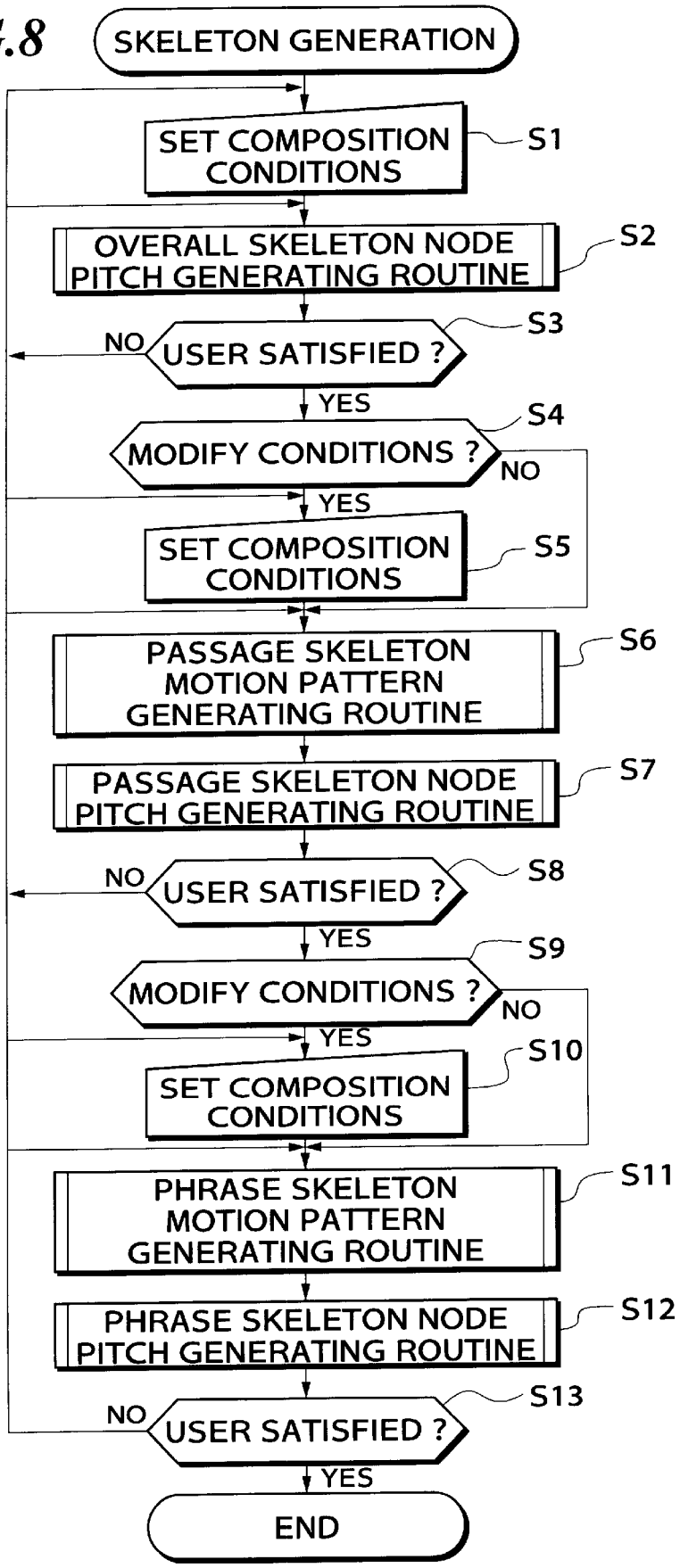
FIG. 8 is a flowchart showing a control flow of a skeleton generating routine executed by a skeleton data modifying unit of FIG. 3.

FIG. 8 is a flowchart showing the control flow of a skeleton generating routine that is executed by the skeleton data modifying unit 33*c*. The skeleton generating operation consists of the overall skeleton modifying operation, passage skeleton modifying operation, and the phrase skeleton modifying operation as explained above with reference to FIG. 3.

In FIG. 8, if the user initially sets or enters composition conditions relating to the overall skeleton, the composition conditions are stored to an overall skeleton condition setting region that is provided at a certain location of the RAM 7 in step S1. The composition conditions include the passage symbols, bridge, the first pitch of the piece of music, the last pitch of the music piece, tone range, chord progression, and dynamics, as described above.

In the next step S2, a subroutine (which will be described later referring to FIG. 9 and FIG. 10) for generating node pitches of the overall skeleton is executed, based on the composition conditions entered in step S1. Step S3 is then executed to ask the user if he/she is satisfied with the node pitches of the overall skeleton thus generated.

If the user replies in step S3 that he/she is satisfied with the generated node pitches, the control flow goes to step S4, and, if the user replies that he/she is not satisfied, the control flow returns to step S1 or S2, so as to set the composition conditions again or only re-generate node pitches of the overall skeleton. The operation of steps S1 to S3 corresponds to the overall skeleton generating operation.

Step S4 is executed to ask the user if the composition conditions are to be changed for the passage skeleton. If the composition conditions are to be changed, the control flow goes to step S5 to set a desired composition condition(s) (only the dynamics in the present embodiment) relating to the passage skeleton, and the newly set composition condition(s) is/are stored to a passage skeleton condition setting region provided at a certain location of the RAM 7. If the composition conditions are not changed, on the other hand, the control flow proceeds to step S6 while skipping step S5.

In step S6, a motion pattern generating subroutine (which will be described later referring to FIG. 11) is executed for generating a motion pattern of the passage skeleton. In the following step S7, a passage skeleton node pitch generating subroutine (which will be described later referring to FIG. 13) is executed for generating node pitches of the passage skeleton, based on the dynamics set in step S5 or the dynamics set in the overall composition condition template, and the motion pattern generated in step S6.

Step S8 is then executed to ask the user if he/she is satisfied with the node pitches of the passage skeleton generated in step S7. If the user replies that he/she is satisfied with the generated node pitches, the control flow goes to step S9. If the user replies that he/she is not satisfied, the control flow returns to any one of step S1, S2, S5 and S6, to re-start from generation of the overall skeleton (when returning to step S1 or S2), or from setting of the composition conditions for the passage skeleton (when returning to step S5), or perform only re-generation of node pitches of the passage skeleton (when returning to step S6). The operations of steps S4 to S8 correspond to the passage skeleton generating operation.

Step S9 is then executed to ask the user if the composition conditions are to be changed for the phrase skeleton. If the composition conditions are to be changed, the control flow goes to step S10 in which the user sets a desired composition condition(s) (only the dynamics in the present embodiment) relating to the phrase skeleton, and the newly set composition condition(s) is/are stored to a phrase skeleton condition setting region provided at a certain location of the RAM 7. If the composition conditions are not to be changed, the control flow goes to step S11 while skipping step In step S11, a motion pattern generating subroutine (which will be described later referring to FIG. 15) for generating the motion pattern of the phrase skeleton is executed. In the following step S12, a node pitch generating routine (which will be described later referring to FIG. 17) for generating node pitches of the phrase skeleton is executed based on the dynamics set in step S10 or the dynamics set in the overall composition condition template, and the motion pattern generated in step S11.

Next, step S13 is executed to ask the user if he/she is satisfied with the node pitches of the phrase skeleton generated in step S12, and, if the user replies that he/she is satisfied, the present skeleton generating operation is finished. If the user replies that he/she is not satisfied, the control flow returns to any one of steps S1, S2, S5, S6, S10 and S11, to re-start from generation of the overall skeleton (when returning to step S1 or S2), or generation of the passage skeleton (when returning to step S5 or S6), or setting of composition conditions for the phrase skeleton (when returning to step S10), or perform only re-generation of the node pitches of the phrase skeleton. The operations of the above steps S9–S13 correspond to the phrase skeleton generating operation.

Figure 9:
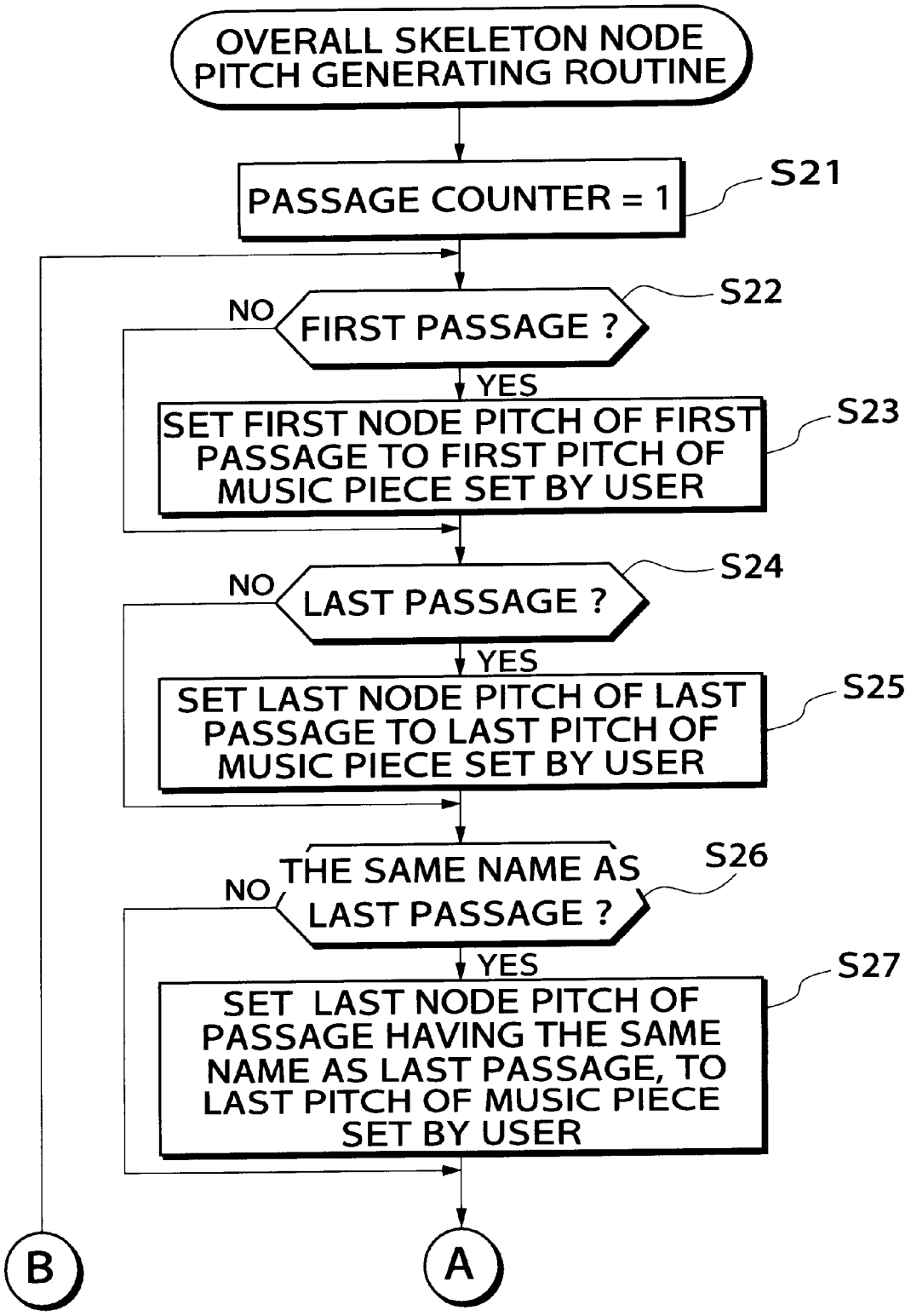
FIG. 9 is a flowchart showing a detailed flow of a subroutine of FIG. 8 for generating node pitches of an overall skeleton.

FIG. 9 is a flowchart showing a detailed flow of the subroutine of the above step S2 for generating the node pitches of the overall skeleton. Before explaining the subroutine for generating the node pitches of the overall skeleton step by step referring to the flowchart, its generation algorithm will be first explained. The node pitch generating operation of the overall skeleton is constructed according to the algorithm as follows:

1) The nodes of the overall skeleton are arranged such that two nodes are present in each passage. For example, the first node corresponds to the first pitch of the first passage, the second node corresponds to the last pitch of the first passage, the third node corresponds to the first pitch of the second passage, the fourth node corresponds to the last pitch of the second passage, and so forth.

2) The first node pitch of the piece of music is set to the first pitch of the piece of music set by the user.

3) The last node pitch of the piece of music is set to the last pitch of the piece of music set by the user.

4) The first node pitch of each passage is determined as follows:

a) Where the passage in question is a same-name passage, the first node pitch of this passage is made identical with the first node pitch of a passage (reference passage) having the same name as the passage in question.

b) Where the passage in question is a first type similar passage, the first node pitch of this passage is made identical with the first node pitch of its reference passage.

c) Where the passage in question does not satisfy either of the conditions a) and b), the first node pitch of the passage in question is selected at random from the constituent notes of the set chord (except 7th note) according to the set dynamics. In the present embodiment, the dynamics may be set to one of the real numbers (discrete values) in the range of 0 to 3. If the dynamics is equal to 0, for example, the first node pitch of the passage in question is determined in a small range (within ±3 degrees, for example) of a difference with the last node pitch of the passage just before the passage in question. If the dynamics is equal to 3, the first node pitch of the passage in question is determined in a large range (within ±8, for example) of a difference with the last node pitch of the passage just before the passage in question. If a bridge is set in the passage in question, the first node pitch is set to a high-tone pitch in principle, which is within the predetermined tone range (between the highest tone and the lowest tone).

5) The last node pitch of each passage is determined as follows:

a) Where the passage in question is a same-name passage, the last node pitch of this passage is made identical with the last node pitch of a passage (reference passage) having the same name as the passage in question.

b) Where the passage in question does not satisfy the condition a), the last node pitch of this passage is selected at random from the constituent notes of the set chord (except 7th note) according to the set dynamics. If the dynamics is equal to 0, for example, the last node pitch of the passage in question is determined in a small range (within ±3 degrees, for example)of a difference with the first node pitch of the passage in question. If the dynamics is equal to 3, the last node pitch of the passage in question is determined in a large range (within ±8, for example) of a difference with the first node pitch of the passage in question. In the both cases, the last node pitch of the passage in question should be set within the predetermined tone range (between the highest tone and the lowest tone).

Figure 19:
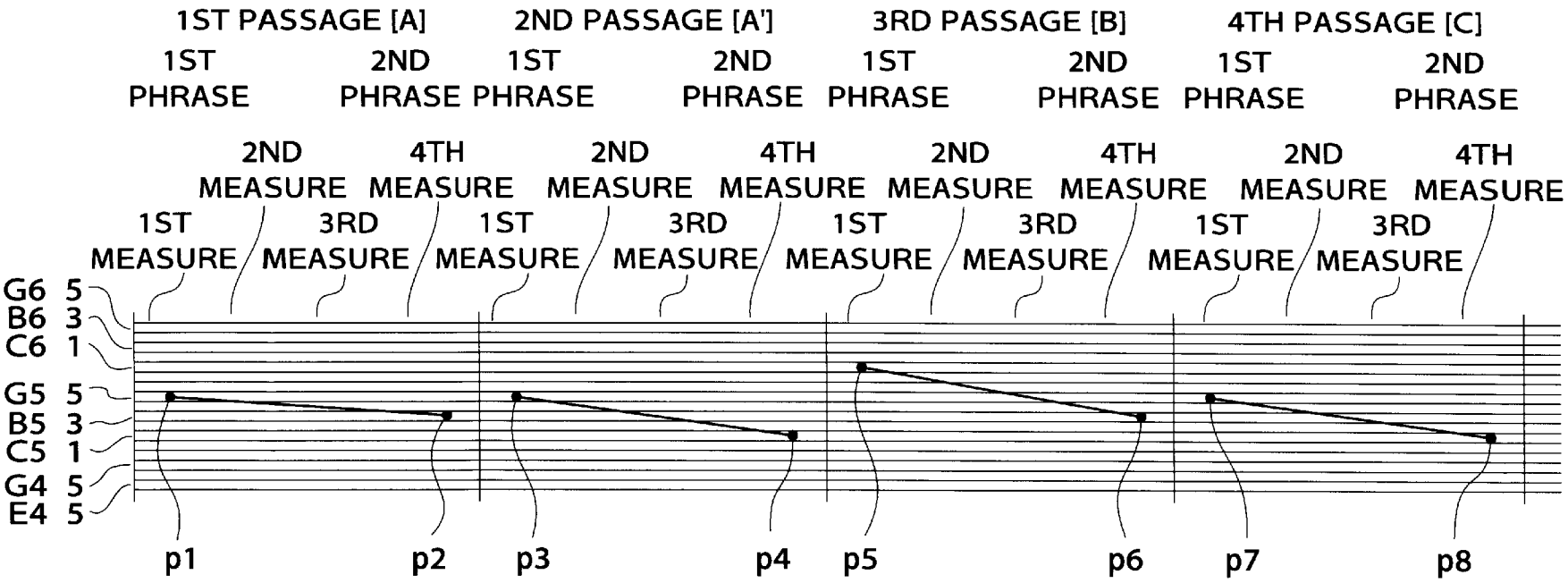
FIG. 19 is a view showing one example of the overall skeleton generated.

Each of the node pitches that constitute the overall skeleton are generated according to the algorithm thus constructed. In the following, the subroutine for generating node pitches of the overall skeleton of the present embodiment will be described step by step, referring to the flowchart of FIG. 9 and FIG. 19 showing an example of the overall skeleton thus generated.

In step S21 of FIG. 9, a passage counter in the form of a soft counter provided in a certain region of the RAM 7 for counting the number of passages is initialized to "1".

Step S22 is then executed to check the count value of the passage counter, and determine whether the passage in question is the first passage or not. If it is the first passage, step S23 is executed to set the first node pitch of the first passage to the first pitch of the piece of music that has been set by the user. If it is not the first passage, the control flow goes to step S24 while skipping step S23. Namely, the operation of step S23 corresponds to 2) of the above-described algorithm, in which the node pitch p1 as shown in FIG. 19 is generated.

Step S24 is then executed to check the passage counter, and determine whether the passage in question is the last passage or not, in a similar manner to step S22. If it is the last passage, step S25 is executed to set the last node pitch of the last passage to the last pitch of the piece of music that has been set by the user. If it is not the last passage, the control flow goes to step S26 while skipping step S25. Namely, the operation of step S25 corresponds to 3) of the above-described algorithm, in which the node pitch p8 as shown in FIG. 19 is generated.

Next, step S26 is executed to check the passage symbol of the passage in question, and determine if the passage in question has the same name or symbol as the last passage, and, if it has the same name, the last node pitch of the passage in question is set to the last pitch of the piece of music set by the user in step S27. If it does not have the same name, the control flow goes to step S28 of FIG. 10 while skipping step S27. In the example of FIG. 19, since no passage has the same name as the last passage ("C"), namely, the fourth passage, the operation of step S27 is not performed in this example, and the control flow goes to step S28.

In step S28, it is determined whether the passage in question is a new passage or not. If it is a new passage, step S29 is executed to randomly select the first node pitch and the last node pitch of the passage in question from chord tones (that constitute the set chord) such that the degrees between the node pitches is held within a range of degrees specified by the set dynamics, and the control flow goes to step S37. If the passage in question is not a new passage, the control flow goes to step S30. If a bridge is set in the passage in question, node pitches of this passage are selected from those in a relatively high-tone range. In the example of FIG. 19, when the passage in question is the first passage, which is a new passage, the last node pitch p2 is determined in step S29 in the manner as described above. (It is to be noted that the-first node pitch p1 has been already determined in step S23, and therefore only the last node pitch is determined in step S29.) When the passage in question is the third passage, which is also a new passage, the first node pitch p5 and the last node pitch p6 are determined in step S29 in the manner as described above. When the passage in question is the fourth passage, which is also a new passage, only the first node pitch p7 is determined since the last node pitch p8 has been already determined in step S27.

In step S30, it is determined whether the passage in question is a same-name passage or not. If it is a same-name passage, step S31 is executed to determine the first and last node pitches of the passage in question to be identical with the first and last node pitches of its reference passage, respectively, and the control flow then goes to step S37. If the passage in question is not a same-name passage, the control flow goes to step S32. In the example of FIG. 19 which does not include any same-name passage, the control flow goes directly from step S30 to step S32.

In step S32, it is determined whether the passage in question is a first type similar passage or not, and, if it is a first type similar passage, step S33 is executed to determine the first node pitch of the passage in question to be identical with the first node pitch of its reference passage. Step S34 is then executed to randomly select the last node pitch of the passage in question from chord tones (that constitute the set chord) such that the degrees between the first and last node pitches is held within a range of degrees specified by the set dynamics, and the control flow goes to step S37. If the passage in question is not a first type similar passage, the control flow goes to step S35. In the example of FIG. 19, when the passage in question is the second passage, which is a first type similar passage of the first passage, step S32 is followed by step S33 in which the first node pitch p3 is determined in the manner as described above (p3=p1), and the last node pitch p4 is then determined in step S34 in the manner as described above.

In step S35, it is determined whether the passage in question is a second type similar passage or not, and, if it is a second type similar passage, step S36 is executed to randomly select the first and last node pitches of the passage in question from chord tones of the set chord in the same manner as in the above step S29, such that the degrees between the first and last node pitches is held within a range of degrees specified by the set dynamics, and the control flow goes to step S37. If the passage in question is not a second type similar passage, the control flow goes to step S37 while skipping step S36. In the example of FIG. 19 that contains no second type similar passage, the control flow goes from step S35 directly to step S37.

Step S37 is executed to check the passage counter, and determine whether the above-described operations have been finished with respect to all of the passages. If any of the passages remains unprocessed, the value of the passage counter is incremented by "1" in step S38, and then the control flow returns to step S22 to repeat the above-described operations. If no passage remains unprocessed, namely, all of the passages have been processed, the control flow goes to step S39.

In step S39, the overall pitch pattern is displayed as shown in FIG. 5. After the apparatus gives a performance of the overall skeleton in the next step S40 as described above, the present subroutine for generating node pitches of the overall skeleton is finished.

Figure 11:
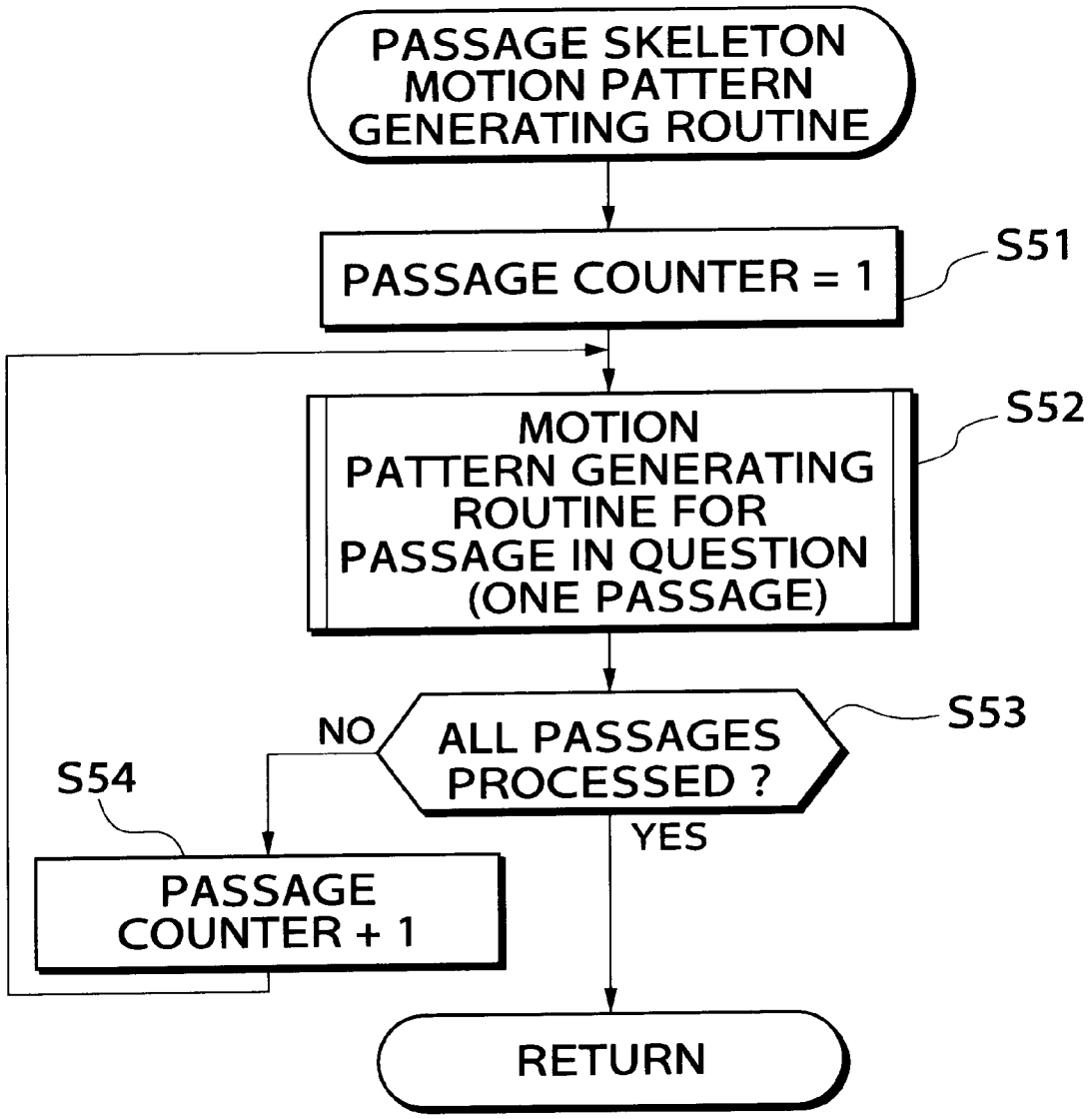
FIG. 11 is a flowchart showing a detailed flow of a subroutine of FIG. 8 for generating a motion pattern of a passage skeleton.

FIG. 11 is a flowchart showing a detailed flow of the subroutine of the above step S6 for generating the motion pattern of the passage skeleton. The motion pattern generating operation will be described step by step referring to the flowchart of FIG. 11, after its generation algorithm is explained.

The motion pattern generating operation of the passage skeleton is constructed according to the algorithm as follows:

1) The nodes of the passage skeleton are arranged such that two nodes are present in each phrase contained in the passage. For example, the first node corresponds to the first pitch of the first phrase, the second node corresponds to the last pitch of the first phrase, the third node corresponds to the first pitch of the second phrase, the fourth node corresponds to the last pitch of the second phrase, and so forth.

2) The motion pattern of each passage is determined as follows:

a) Where the passage in question is a same-name passage, the motion pattern of this passage is set to be identical with the motion pattern of a passage (reference passage) having the same name.

b) Where the passage in question is a first type similar passage, the motion pattern of this passage is determined such that the motion pattern except the last section of the passage in question is made identical with that of the reference passage, and the motion pattern of the last section is set to a pattern which converges on the last pitch of the passage in question.

c) Where the passage in question does not satisfy either of the conditions a) and b), the motion pattern of this passage is determined at random so that the node pitches are held within the range of the set tone range (between the highest tone and the lowest tone).

Figure 21A:
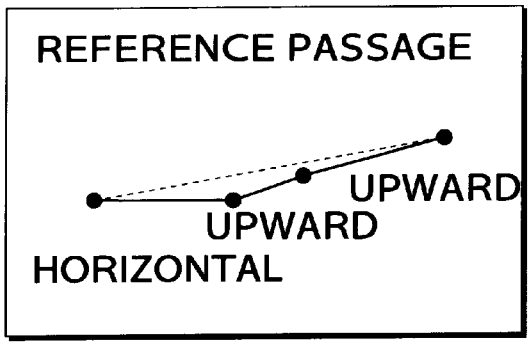
FIG. 21A and FIG. 21B are views useful in explaining a motion pattern that converges on the last pitch of a passage.
Figure 21B:
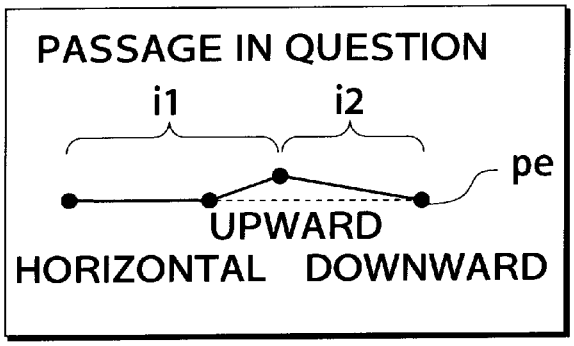

FIG. 21A and FIG. 21B are views useful in explaining the motion pattern that converges on the last pitch of the passage, wherein FIG. 21A shows one example of the motion pattern of the reference passage, and FIG. 21B shows the motion pattern of the passage in question that has been generated. In FIG. 21B, a portion i2 of the passage represents the last section, and a portion i1 of the passage represents a section other than the last section.

Suppose the passage in question satisfies the above condition b), the motion pattern of the section i1 is determined to be identical with that of the corresponding section of the reference passage, as described above. In the example of FIGS. 21A and 21B, the motion pattern in this section i1 consists of a horizontal motion and an upward motion. The motion pattern of the section i2 is then determined so as to converge on the last pitch of the passage in question. Namely, the last section of the passage in question contains a downward motion (converging on the last pitch pe) even though the last section of the reference passage contains an upward motion. By the time when the subroutine for generating the motion pattern of the passage skeleton is executed, the last node pitch pc has been already determined, and therefore the motion pattern is determined so as to maintain the last node pitch.

According to the algorithm constructed as described above, the motion pattern of each passage skeleton is generated. The operation of the present embodiment for generating the motion pattern of the passage skeleton will be explained step by step, referring to the flowchart of FIG. 11, and FIG. 20 showing an example of generation of the motion pattern of each passage skeleton.

In FIG. 11, step S51 is initially executed to initialize the passage counter to "1" as in step S21 of FIG. 9.

Figure 12:
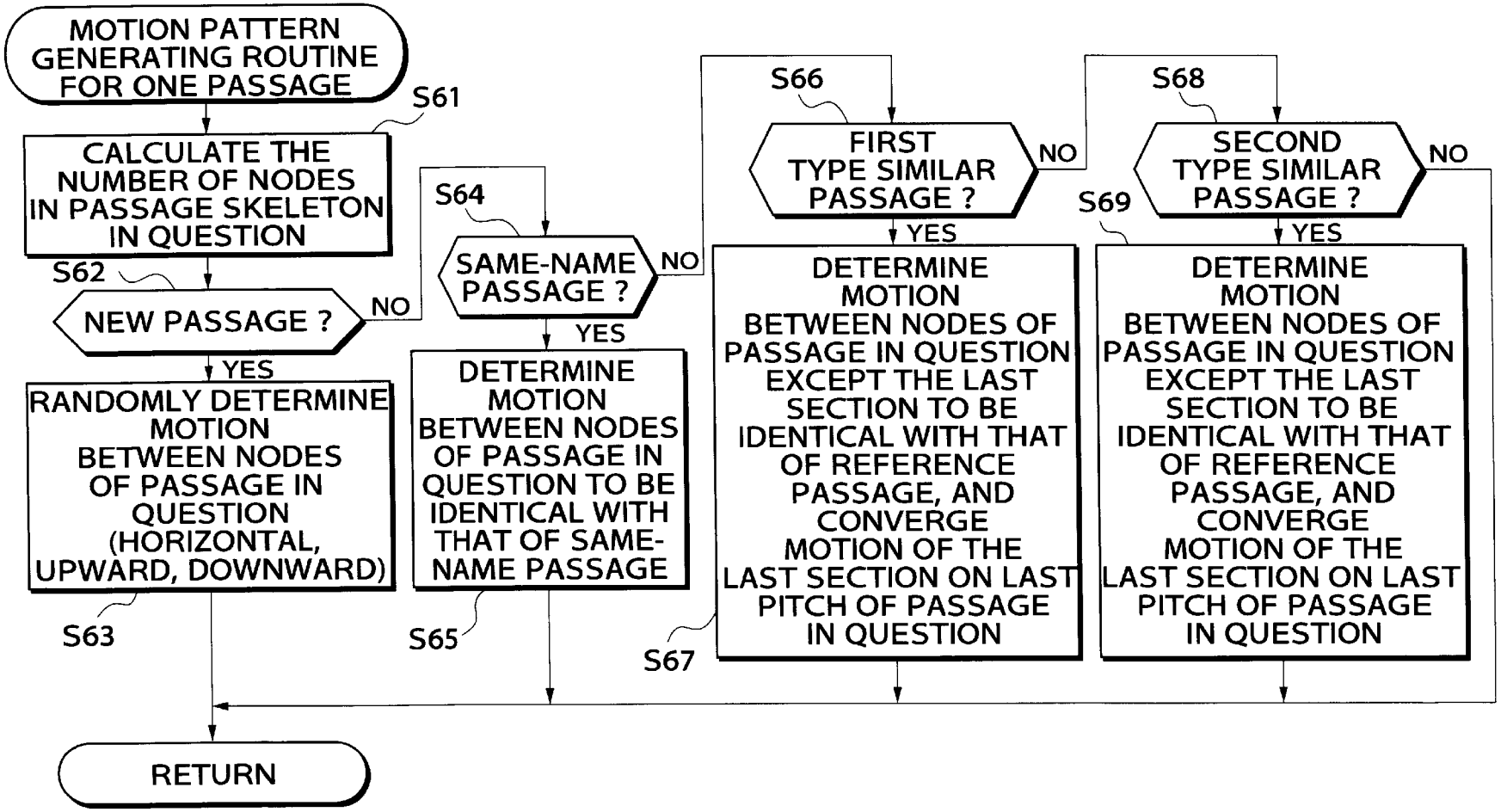
FIG. 12 is a flowchart showing a detailed flow of a subroutine of FIG. 11 for generating a motion pattern of one passage.

In the next step S52, a subroutine that will be described later referring to FIG. 12 is executed for generating the motion pattern of the passage (one passage) in question.

Figure 10:
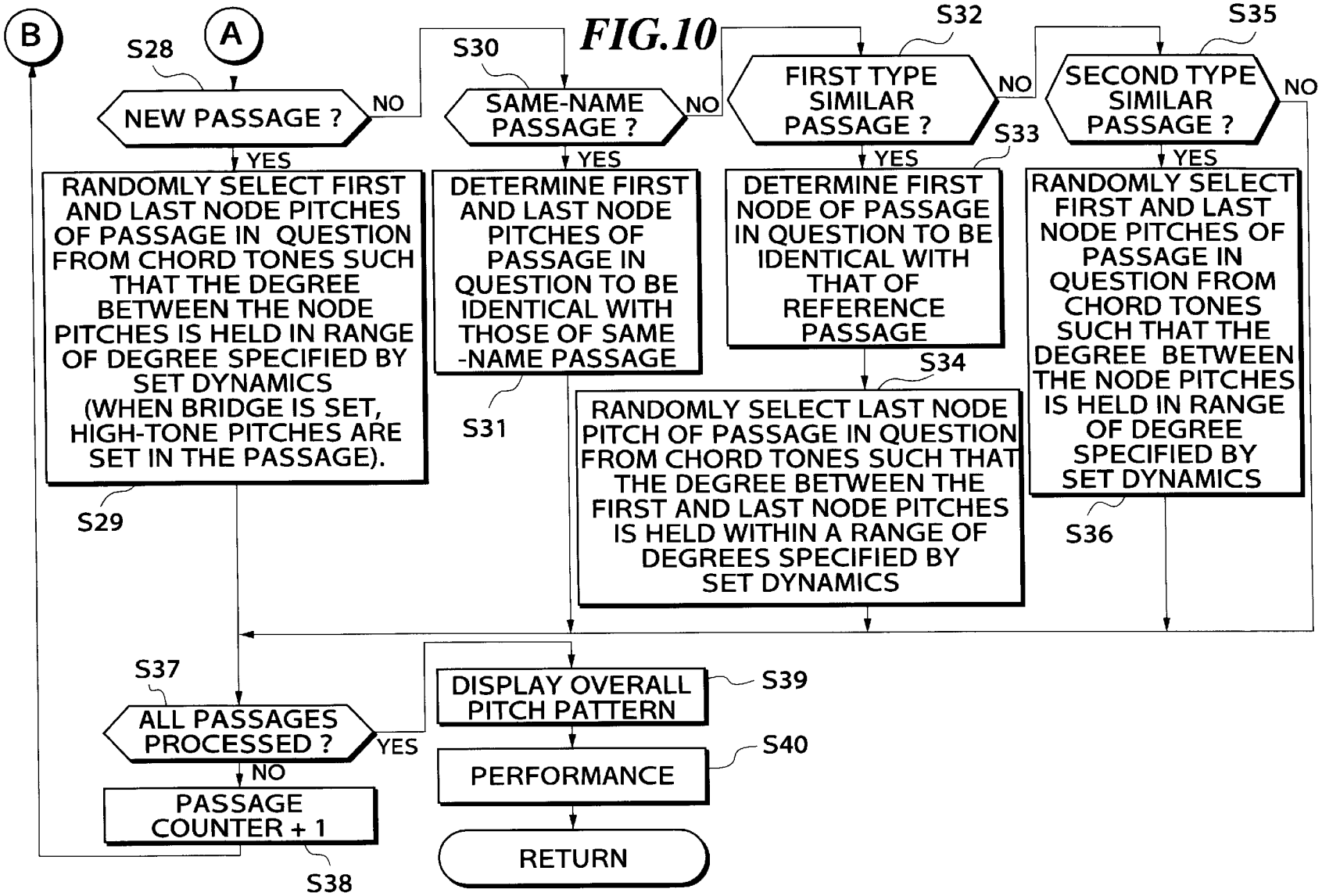
FIG. 10 is a flowchart showing a detailed flow of a continued part of the subroutine of FIG. 8 for generating node pitches of the overall skeleton.

Step S53 is then executed to determine whether the above motion pattern generating operation has been finished with respect to all of the passages, as in step S37 of FIG. 10. If any of the passages still remains unprocessed, the value of the passage counter is incremented by "1" in step S54, as in step S38 of FIG. 10, and then the control flow returns to step S52 to repeat the above-described operations. If no passage remains unprocessed, namely, all of the passages have been processed, the present operation for generating the motion pattern of the passage skeleton is finished.

FIG. 12 is a flowchart showing a detailed flow of the subroutine of step S52 for generating the motion pattern of one passage.

In FIG. 12, step S61 is first executed to calculate the number of nodes contained in the passage skeleton in question. As described above, the number of nodes per passage is twice the number of phrases contained in the passage in question, and is therefore determined according to the following equation:

$$\text{Number of nodes}=\text{Number of phrases}\times 2$$

Figures 20A, 20B:
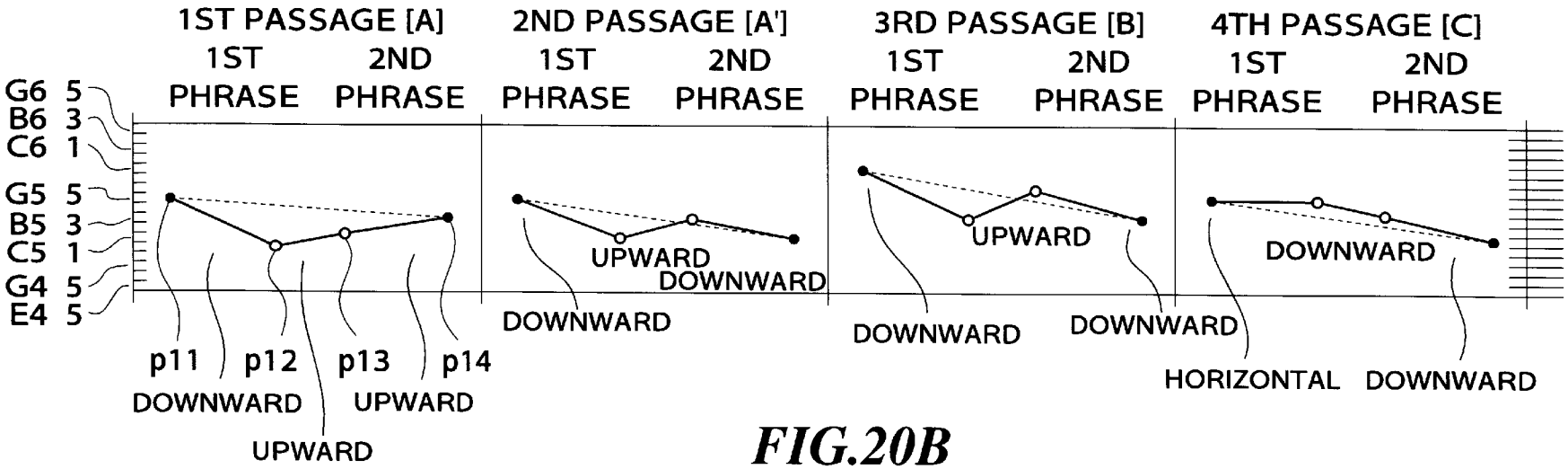
FIG. 20A and FIG. 20B are views showing one example of the generated motion pattern of the passage skeleton.

In the example of FIG. 20A in which each passage consists of two phrases, the number of nodes is four with respect to each passage, namely, each passage contains four nodes.

Subsequently, steps S62, S64, S66 and S68 similar to steps S28, S30, S32 and S35 of FIG. 10 are executed to determine whether the passage in question is a new passage, same-name passage, first type similar passage, or a second type similar passage.

If the passage in question is a new passage as a result of the determination in step S62, the control flow goes to step S63 in which the motion between adjacent nodes of the passage in question is determined at random. Namely, any one of the "horizontal" motion, "upward" motion and "downward" motion may be selected at random, and set as the motion between the adjacent nodes. In the example of FIG. 20A, where the passage in question is the first passage, which is a new passage, the motion between adjacent nodes, namely, each motion between nodes p11 and p12, p12 and p13, and p13 and p14, is determined at random as described above. In this example, the motions of the respective sections 1, 2, and 3 are determined as "downward", "upward", and "upward", respectively. The motions between adjacent nodes of other new passages in FIG. 20A, i.e., the third and fourth passages, are also determined at random in a similar manner.

Where the passage in question is a same-name passage, the control flow goes from step S64 to step S65 in which the motions between adjacent nodes of the passage in question are determined to be identical with those of a reference passage having the same name or symbol as the passage in question. In the example of FIG. 20A, no same-name passage is included in the piece of music, and therefore the control flow goes from step S64 to step S66.

Where the passage in question is a first type similar passage, the control flow proceeds from step S66 to step S67 in which the motions between adjacent nodes of the passage in question are determined to be identical with those of its reference passage except the last section, and the motion of the last section is determined so as to converge on the last pitch of the passage in question. In the example of FIG. 20A, where the passage in question is the second passage, which is a first type similar passage, step S67 is executed to determine the motions between adjacent nodes to be identical with those of the first passage as the reference passage, except the last section, and determine the motion of the last section as explained above with reference to FIGS. 21A–B.

Where the passage in question is a second type similar passage, the control flow goes from step S68 to step S69 in which an operation similar to that of the above step S67 is performed. In the example of FIG. 20A, no second type similar passage is included in the piece of music, and therefore the operation for generating the motion pattern of the present passage is immediately finished after execution of step S68.

Once the motion pattern for each passage of a piece of music is determined as described above, the resulting data is stored to a motion pattern storage region that is provided at a certain location of the RAM 7 such that each data is associated with the section number of each passage.

Figure 13:
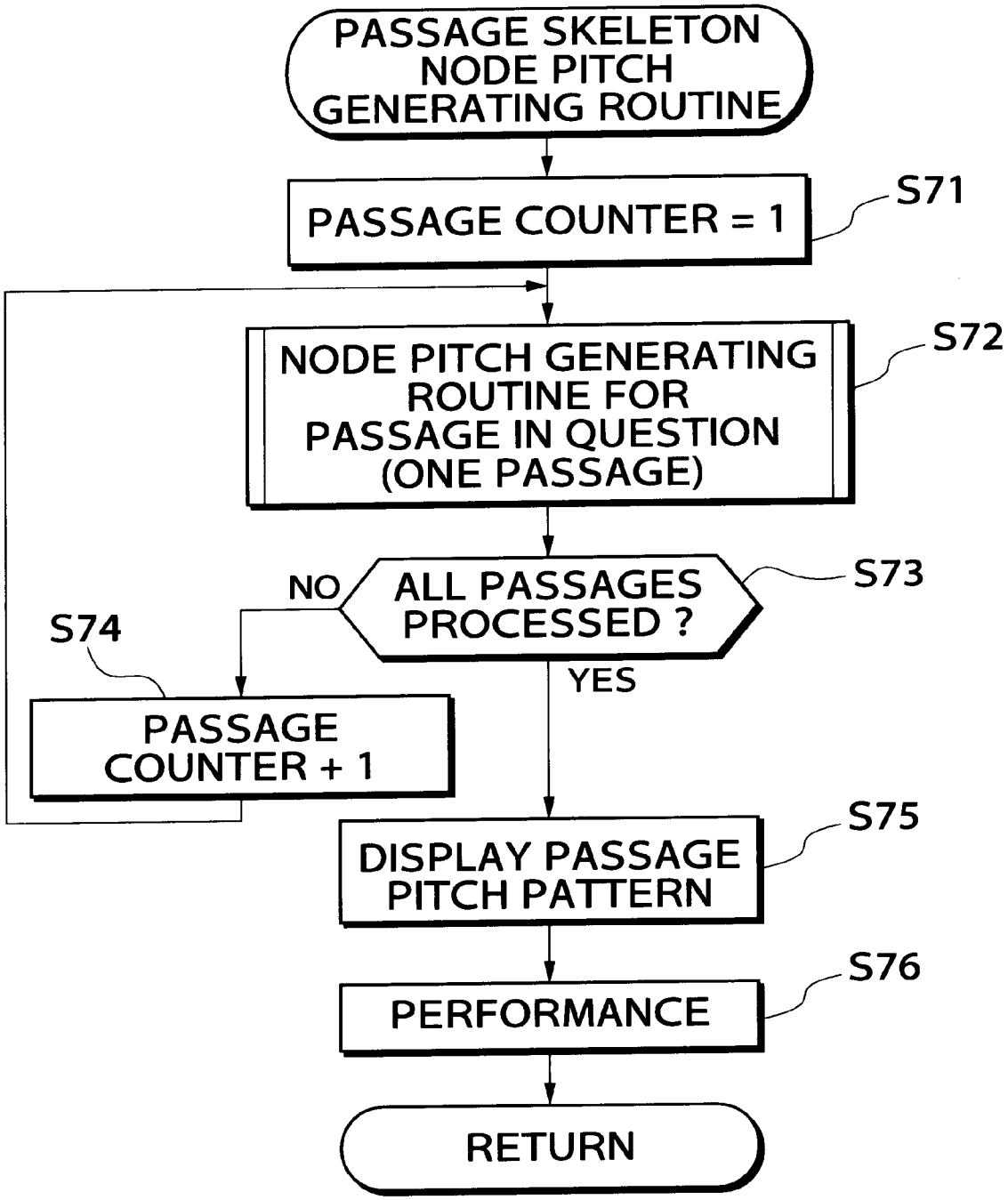
FIG. 13 is a flowchart showing a detailed flow of a subroutine of FIG. 8 for generating node pitches of the passage skeleton.

FIG. 13 is a flowchart showing a detailed flow of the subroutine of the above step S7 of FIG. 8 for generating node pitches of the passage skeleton. In the following, the node pitch generating operation will be described step by step referring to the flowchart of FIG. 13, after its generation algorithm is explained.

The operation for generating node pitches of the passage skeleton is constructed according to the algorithm as follows:

1) The first node pitch of each passage is set to the first node pitch of the passage in question which has been determined in the overall skeleton node pitch generating operation (step S2 of FIG. 8).

2) The last node pitch of each passage is set to the last node pitch of the passage in question which has been determined in the overall skeleton node pitch generating operation as in 1) above.

3) The first node pitch of each phrase is determined as follows:

a) Where the passage in question is a same-name passage, the first node pitch of each phrase is made identical with the first node pitch of the phrase corresponding to a passage (reference passage) having the same name as the passage in question.

b) Where the passage in question is a first type similar passage, the first node pitch of each phrase is selected at random from the constituent notes of the set chord (except 7th note) according to the corresponding motion pattern generated in the motion pattern generating operation for the passage skeleton, and the set dynamics, and, if possible, is made identical with the first node pitch of the corresponding phrase of the reference passage.

c) Where the passage in question does not satisfy either of the conditions a) and b), the first node pitch of each phrase is selected at random from the constituent notes of the set chord (except 7th note) according to the corresponding motion pattern generated in the motion pattern generating operation for the passage skeleton, and the set dynamics.

4) The last node pitch of each phrase is determined as follows:

a) Where the passage in question is a same-name passage, the last node pitch of each phrase is made identical with the last node pitch of the corresponding phrase of a passage (reference passage) having the same name as the passage in question.

b) Where the passage in question is a first type similar passage, the last node pitch of each phrase is selected at random from the constituent notes of the set chord (except 7th note) according to the corresponding motion pattern generated in the motion pattern generating operation for the passage skeleton, and the set dynamics, and, if possible, is made identical with the last node pitch of the corresponding phrase of the reference passage.

c) Where the passage in question does not satisfy either of the conditions a) and b), the last node pitch of each phrase is selected at random from the constituent notes of the set chord (except 7th note) according to the corresponding motion pattern generated in the motion pattern generating operation for the passage skeleton, and the set dynamics.

The relationship between the value set as the dynamics and the selected node pitches is similar to the relationship as described above with respect to the node pitch generating operation for the overall skeleton.

Figure 22:
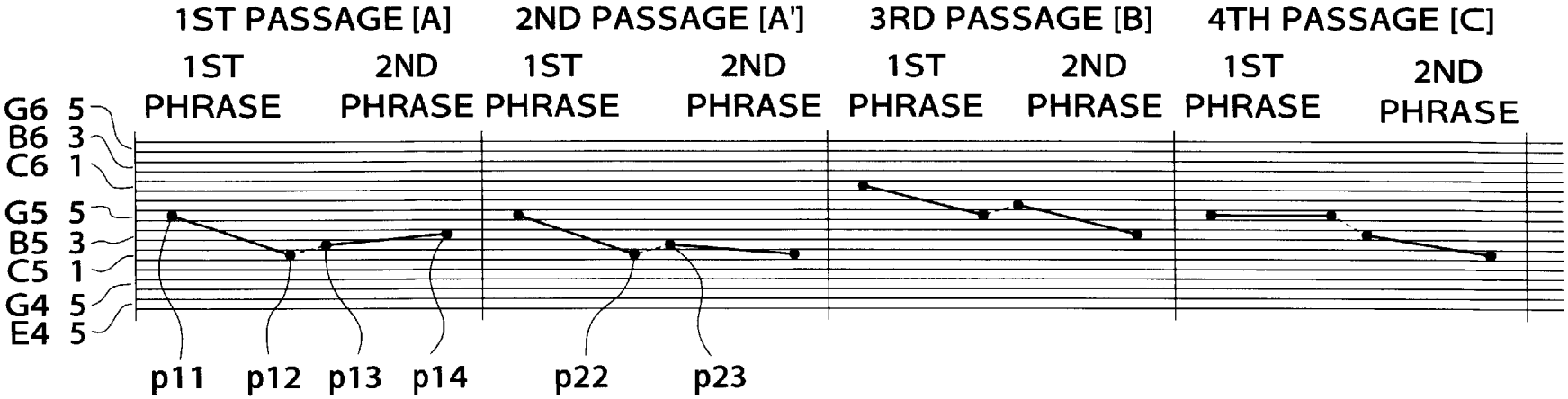
FIG. 22 is a view showing one example of the generated node pitches of the passage skeleton.

According to the algorithm constructed as described above, node pitches that constitute each passage are generated over the entire piece of music. The node pitch generating operation for the passage skeleton will be described step by step, referring to the flowchart of FIG. 13, and also FIG. 22 showing an example of node pitches generated for each passage skeleton.

In FIG. 13, step S71 is first executed to initialize the passage counter as in step S21 of FIG. 9.

Figure 14:
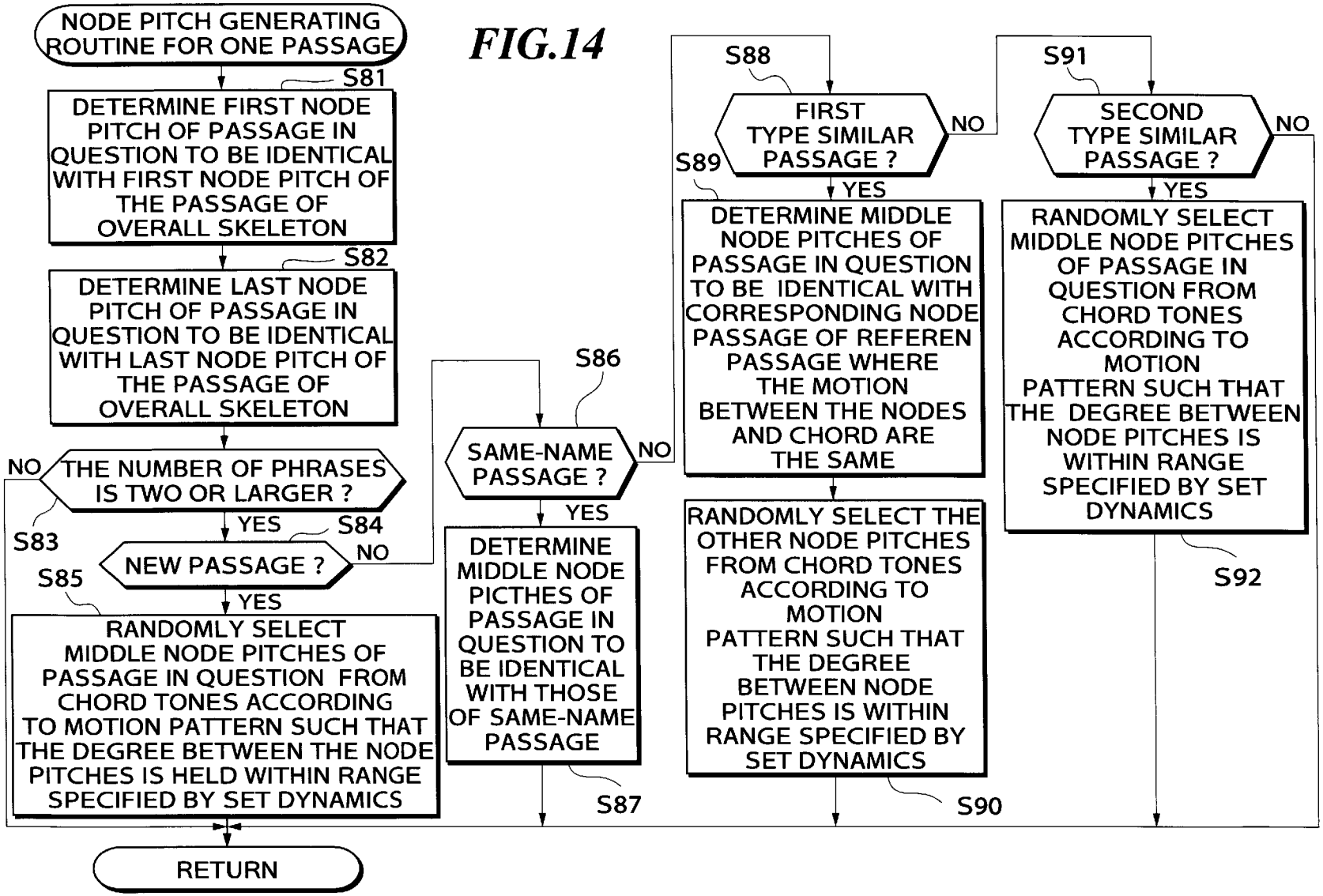
FIG. 14 is a flowchart showing a detailed flow of a subroutine of FIG. 13 for generating node pitches of one passage.

In the next step S72, a subroutine of a node pitch generating operation for the passage in question (one passage), which will be described later referring to FIG. 14, is executed.

Step S73 is then executed to determine whether the above-described operation has been finished with respect to all of the passages, as in step S37 of FIG. 10. If any of the passages still remains unprocessed, the value of the passage counter is incremented by "1" in step S74, as in step S38 of FIG. 10, and then the control flow returns to step S72 to repeat the above-described operation. If no passage remains unprocessed, namely, all of the passages have been processed, the control flow goes to step S75.

In step S75, the passage pitch pattern is displayed as shown in FIG. 6, and step S76 is then executed to give a performance of the passage skeleton as described above. The node pitch generating operation for the passage skeleton is then finished.

FIG. 14 is a flowchart showing a detailed flow of the subroutine of step S72 for generating node pitches contained in one passage.

In FIG. 14, step S81 is initially executed to determine the first node pitch of the passage in question to be identical with the first node pitch of the passage in question of the overall skeleton that has been generated in the node pitch generating operation for the overall skeleton. This step corresponds to 1) of the above-described algorithm. In the example of FIG. 22, where the passage in question is the first passage, the above operation is performed to determine the first node pitch p11 to be identical with the first node pitch p1 of FIG. 19.

Next, step S82 is executed to determine the last node pitch of the passage in question to be identical with the last node pitch of the passage in question of the overall passage that has been generated in the node pitch generating operation for the overall skeleton. This step corresponds to 2) of the above-described algorithm. In the example of FIG. 22, where the passage in question is the first passage, the above operation is performed to determine the last node pitch p14 to be identical with the last node pitch p2 of FIG. 19.

Step S83 is then executed to determine whether the number of phrases contained in the passage in question is equal to or larger than "2". When the number of phrases is less than 2, namely, when the number of phrases is equal to 1, the node pitch generating operation for the present passage is finished since the node pitches of this passage have been determined in step S81 and step S82. If the number of phrases is equal to or larger than 2, there exist node pitches that are to be determined, and therefore the control flow goes to steps S84.

Subsequently, steps S84, S86, S88 and S91 similar to step S28, S30, S32 and S35 of FIG. 10 are executed to determine whether the passage in question is a new passage, same-name passage, first type similar passage, and a second type similar passage, respectively.

Where the passage in question is a new passage as a result of the determination in step S84, the control flow goes to step S85 in which middle node pitches of the passage in question are selected at random from chord tones (that constitute the set chord) according to the motion pattern such that the degree between the node pitches is held within a range of degrees specified by the set dynamics. Here, if two phrases are contained in the passage in question, the middle node pitches mean both the last node pitch of the first phrase and the first node pitch of the second phase (the first and last node pitches of the passage in question have been already determined). Where the passage in question contains three or more phrases, the middle node pitches mean all of the node pitches other than the first node pitch of the first phrase and the last node pitch of the last phrase. Thus, in the example of FIG. 22, the node pitches p12 and p13 of the first passage are determined.

Where the passage in question is a same-name passage, the control flow goes from step S86 to step S87 in which the middle node pitches of the passage in question are determined to be identical with those of a passage (reference passage) having the same name as the passage in question. In the example of FIG. 22, no same-name passage is set in the piece of music, the control flow goes from step S86 to step S88.

Where the passage in question is a first type similar passage, the control flow goes from step S88 to step S89 in which the middle node pitches of the passage in question are determined to be identical with the corresponding node pitches of the reference passage provided that the motion between the corresponding nodes of the reference passage and its chord are the same as those of the passage in question. In the following step S90, the other node pitches are determined in the same manner as in the above step S85. In the example of FIG. 22, where the passage in question is the second passage, which is a first type similar passage, the node pitches p22 and p23 are determined as described above.

Where the passage in question is a second type similar passage, the control flow goes from step S91 to step S92 in which the middle node pitches of the passage in question are determined in the same manner as in step S85 as described above. In the example of FIG. 22, no second type similar passage is contained in the piece of music, and therefore step S92 is not executed, and the node pitch generating operation for one passage in question is finished.

Figure 15:
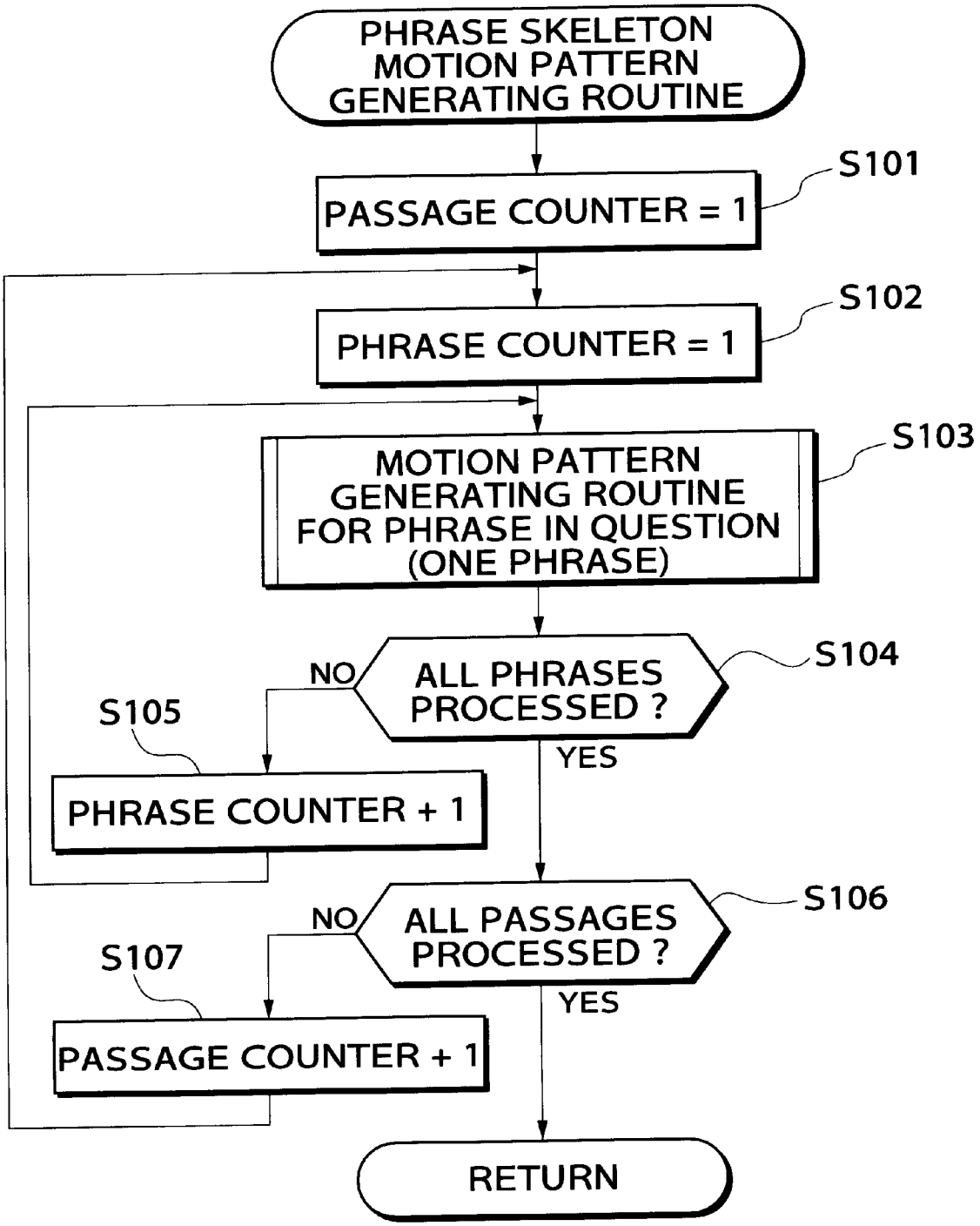
FIG. 15 is a flowchart showing a detailed flow of a subroutine of FIG. 8 for generating a motion pattern of a phrase skeleton.

FIG. 15 is a flowchart showing a detailed flow of the subroutine of the above step S11 for generating the motion pattern of the phrase skeleton. Before explaining the control routine of FIG. 15, its generation algorithm will be explained.

The motion pattern generating operation of the phrase skeleton is constructed according to the algorithm as follows:

1) The nodes of the phrase skeleton are arranged such that two nodes at maximum are present in each measure contained in the phrase. For example, the first node corresponds to the first pitch of the first measure, the second node corresponds to the pitch of an important tone-generation point (which will be described later) of the first measure, the third node corresponds to the first pitch of the second measure, the fourth node corresponds to the pitch of an important tone-generation point of the second measure, and so forth.

2) The motion pattern of each phrase is determined as follows:

a) Where the passage in question is a same-name passage, the motion pattern of each phrase is made identical with that of the corresponding phrase of a passage (reference passage) having the same name as the passage in question.

b) Where the passage in question is a first type similar passage, the motion pattern of each phrase is determined such that the motion pattern of each phrase of the passage in question except the last section is made identical with that of the corresponding phrase of the reference passage, and the motion pattern of the last section is set to a motion pattern which converges on the last pitch of the passage in question.

c) Where the passage in question does not satisfy either of the conditions a) and b), the motion pattern of each phrase is determined at random so that the node pitches are held within the range of the set tone range (between the highest tone and the lowest tone).

Figure 16:
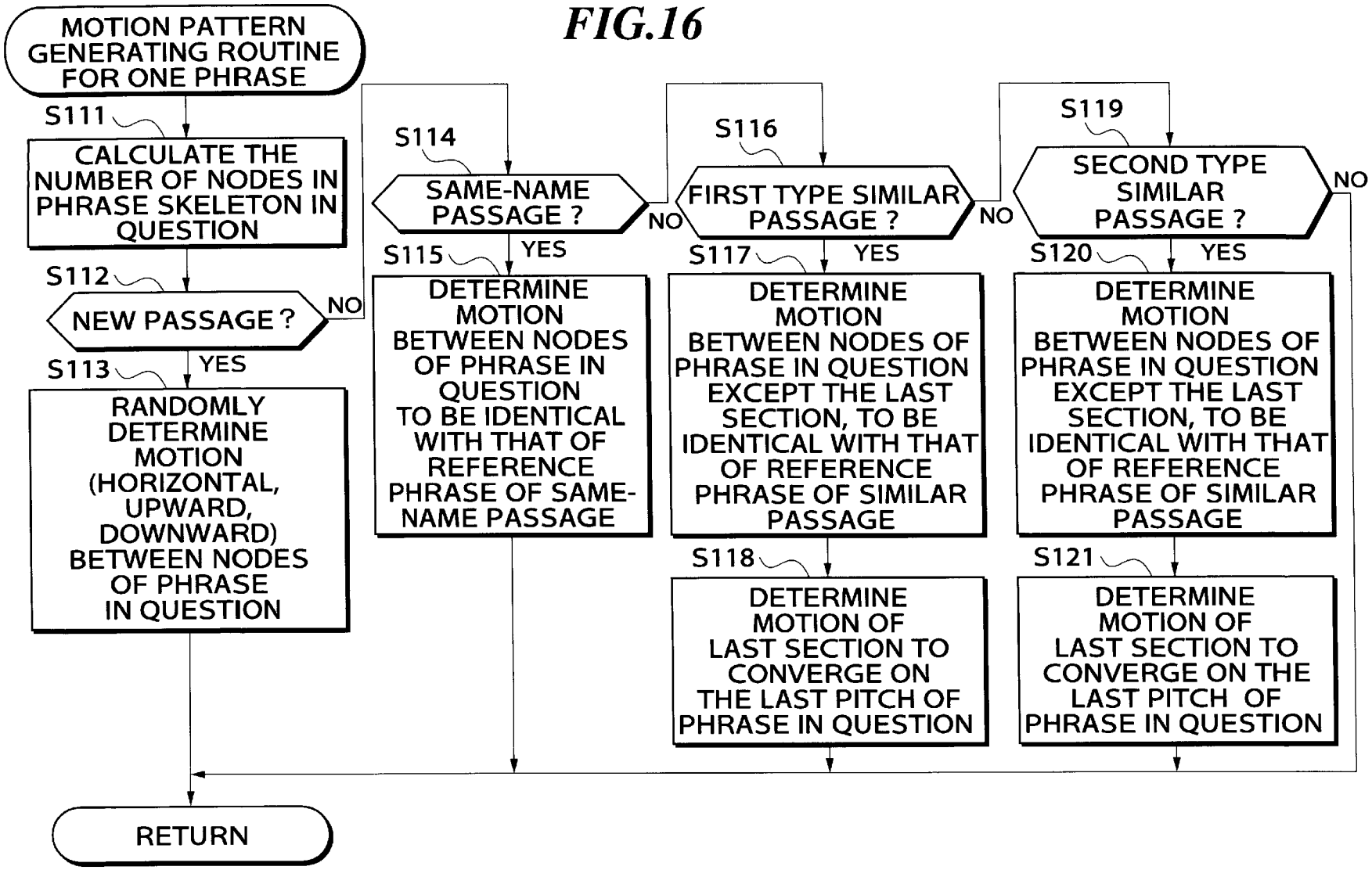
FIG. 16 is a flowchart showing a detailed flow of a subroutine of FIG. 15 for generating a motion pattern of one phrase.

The above algorithm for generating the motion pattern of the phrase skeleton is different from the algorithm for generating the motion pattern of the passage skeleton only in that the motion pattern is generated with respect to phrases in the former operation, whereas the motion pattern is generated with respect to passages in the latter operation. Thus, the algorithms for these operations are essentially the same as each other, and therefore the motion pattern generating operation for the phrase skeleton can be easily realized based on the motion pattern generating operation for the passage skeleton, merely by changing the object of the motion pattern generation. Thus, the motion pattern generating operation for the phrase skeleton is generally illustrated in FIG. 15 and FIG. 16 description, of which is omitted.

Figures 23A, 23B:
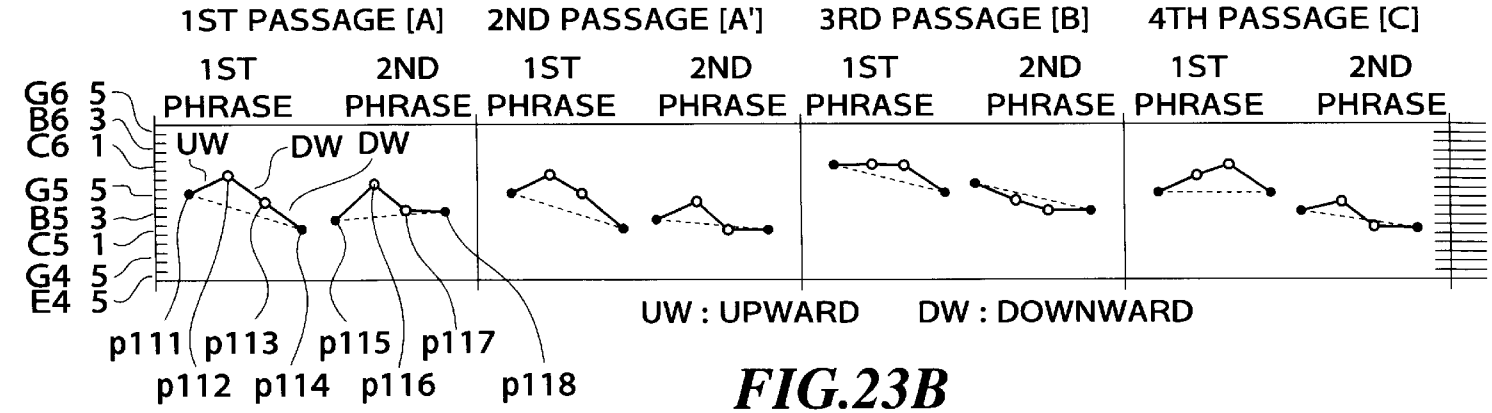
FIG. 23A and FIG. 23B are views showing one example of the motion pattern of the phrase skeleton generated.

FIG. 23A and FIG. 23B show one example of the motion pattern of the phrase skeleton generated in the above manner. Since FIG. 23A corresponds to FIG. 20A as described above, and FIG. 23B corresponds to FIG. 20B, no explanation of FIGS. 23A, 23B will be provided.

Figure 17:
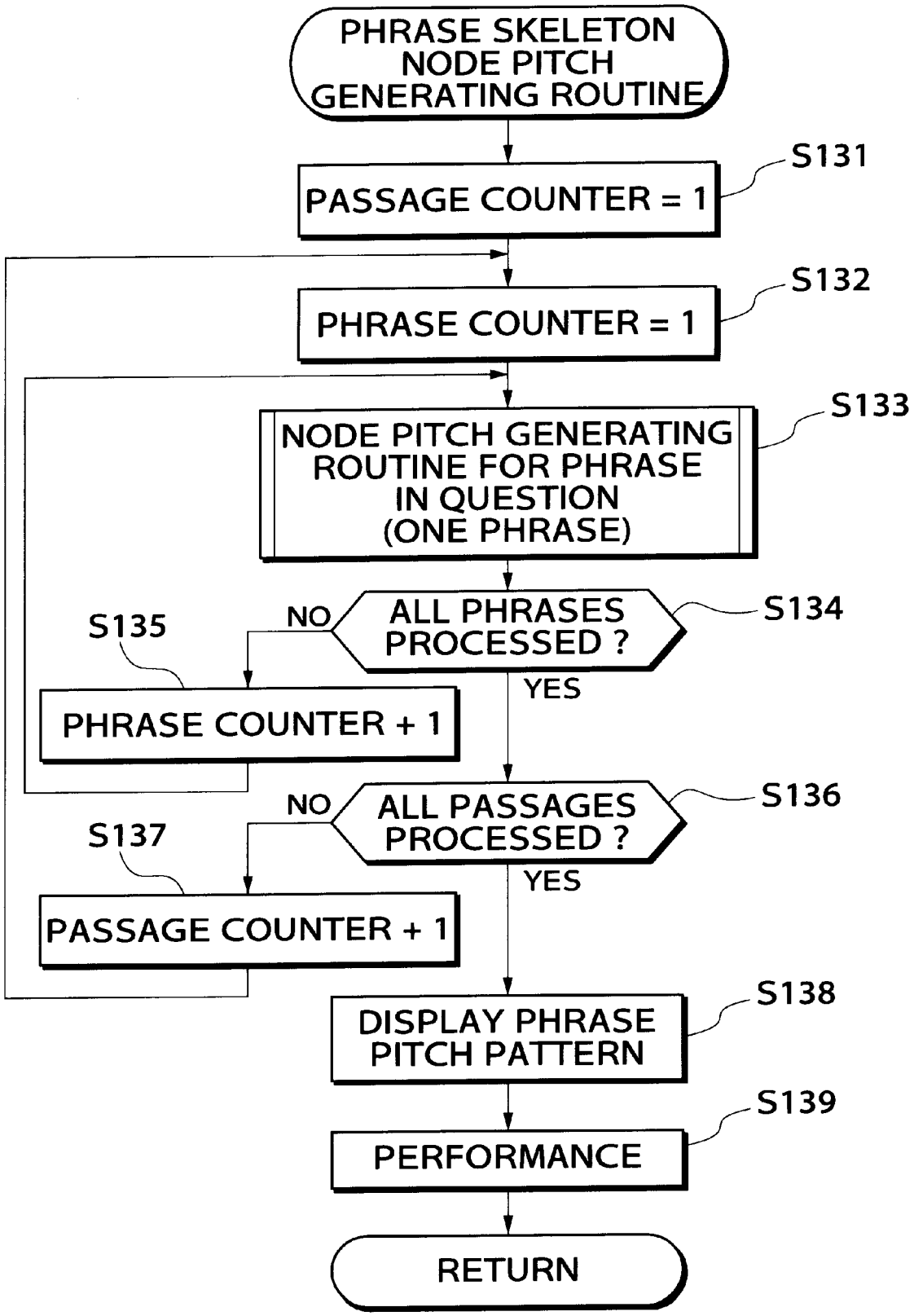
FIG. 17 is a flowchart showing a detailed flow of a subroutine of FIG. 8 for generating node pitches of the phrase skeleton.

FIG. 17 is a flowchart showing a detailed flow of the subroutine of step S12 of FIG. 8 for generating node pitches of the phrase skeleton. Before explaining the control routine of FIG. 17, its generation algorithm will be explained below.

The operation for generating node pitches of the phrase skeleton is constructed according to the algorithm as follows:

1) The first node pitch of each phrase is set to the first node pitch of the phrase in question which has been determined in the passage skeleton node pitch generating operation (step S7 of FIG. 8).

2) The last node pitch of each phrase is set to the last node pitch of the phrase in question which has been determined in the passage skeleton node pitch generating operation as in 1) above.

3) The middle node pitches of each phrase are set to pitches of tone-generation points that are determined according to the algorithm for determining important tone-generation points as described below, and are determined as follows:

a) Where the passage in question is a same-name passage, the middle node pitches of each phrase are made identical with the corresponding node pitches of the corresponding phrase of a passage (reference passage) having the same name as the passage in question.

b) Where the passage in question is a first type similar passage, the middle node pitches of each phrase are selected at random from the constituent notes of the set chord (except 7th note) according to the corresponding motion pattern generated in the motion pattern generating operation for the phrase skeleton, and the set dynamics, and, if possible, are made identical with the corresponding node pitches of the corresponding phrase of its reference passage.

c) Where the passage in question does not satisfy either of the conditions a) and b), the middle node pitches of each phrase are selected at random from the constituent notes of the set chord (except 7th note) according to the corresponding motion pattern generated in the motion pattern generating operation for the phrase skeleton, and the set dynamics.

The relationship between the value set as the dynamics and the selected node pitches is similar to the relationship as described above with respect to the node pitch generating operation for the overall skeleton.

The algorithm for determining important tone-generation points is constructed as follows:

1) The important tone-generation points are arranged such that each measure contains two important tone-generation points at maximum. Where the measure in question contains only one syllable, however, only one tone-generation point is contained in that measure.

2) The first important tone-generation point is set to the first tone-generation point of the measure in question.

3) The second important tone-generation point is determined as follows:

a) Where the measure in question is not the last measure of the phrase, i) the first priority: the second important tone-generation point is set to a tone-generating point, if any, that is set to present at the third beat, or p2 ii) the second priority: the second important tone-generation point is set to a tone-generating point (key-on event) having the maximum duration (an event accompanying each key-on event and representing an interval between the present key-on event and the key-on event immediately before the present key-on event). Thus, the second important tone-generation point (=node) may not be the last tone-generation point of the measure in question.

b) Where the measure in question is the last measure of the phrase, the second important tone-generation point is set to the last tone-generation point of the measure in question.

Figure 24:
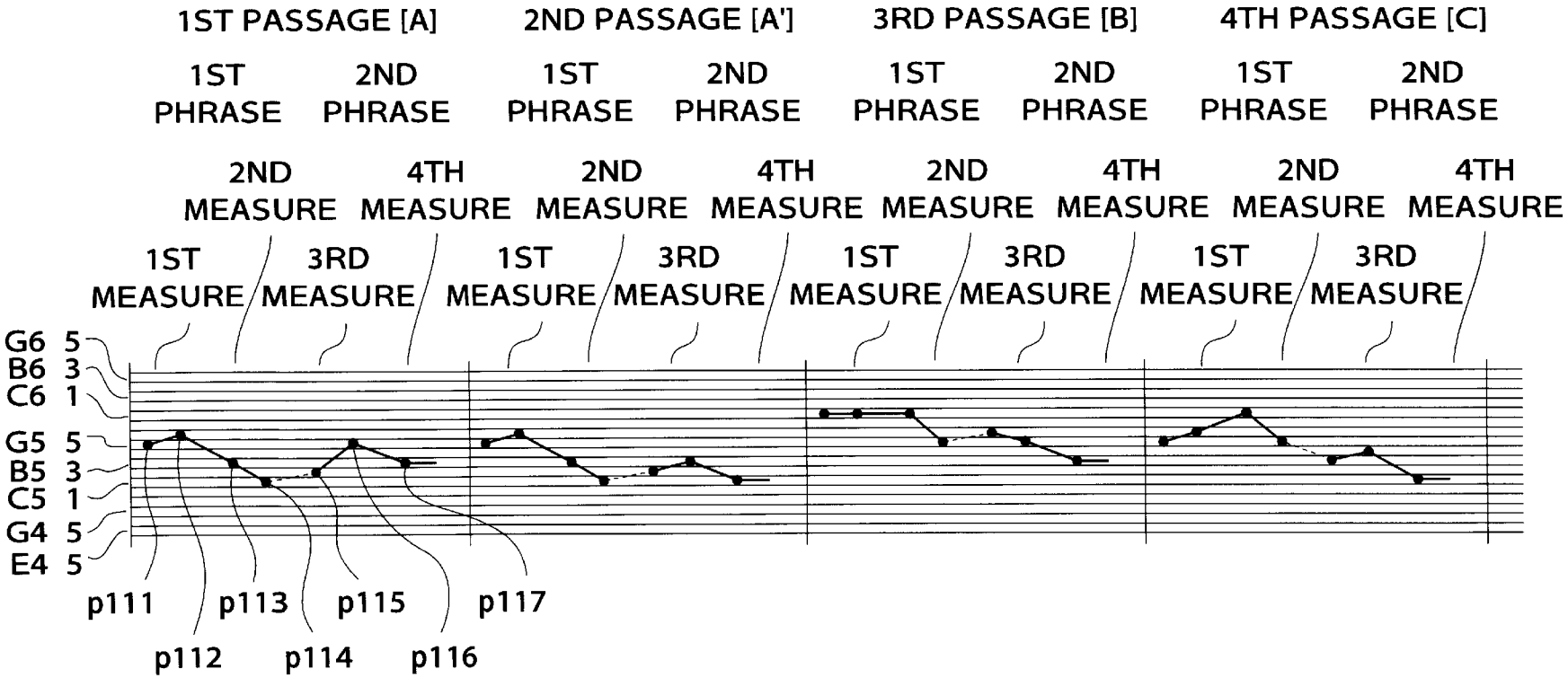
FIG. 24 is a view showing one example of the generated node pitches of the phrase skeleton.

According to the algorithm constructed as described above, node pitches that constitute each phrase are generated over the entire piece of music. The node pitch generating operation for the phrase skeleton will be described step by step, referring to the flowchart of FIG. 17, and also FIG. 24 showing an example of node pitches generated with respect to each phrase skeleton.

In FIG. 17, step S131 is first executed to initialize the passage counter in a similar manner to step S21 of FIG. 9.

Step S132 is then executed to initialize a phrase counter in the form of a soft counter provided in the RAM 7, like the passage counter, for counting the number of phrases.

Figure 18:
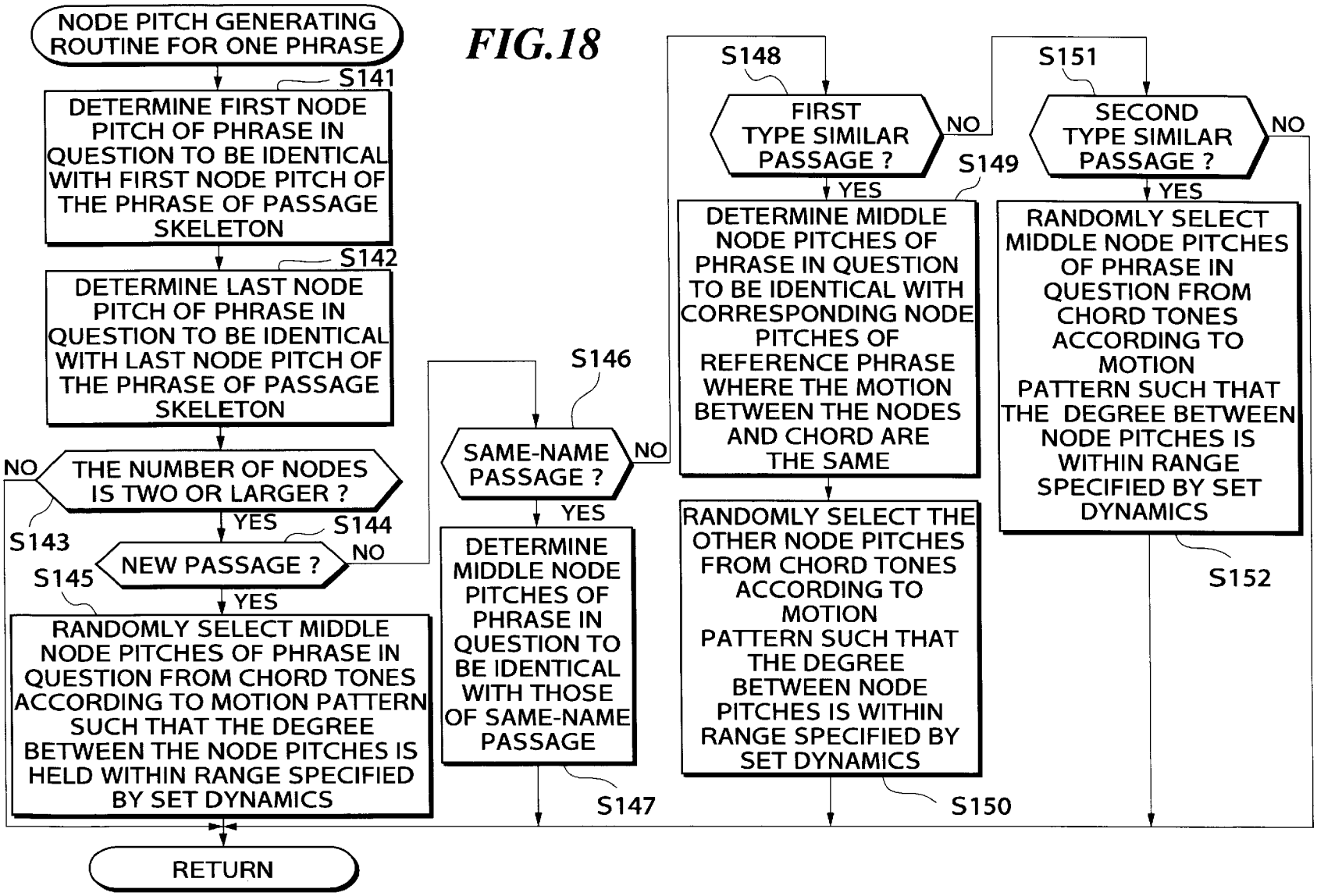
FIG. 18 is a flowchart showing a detailed flow of a subroutine of FIG. 17 for generating node pitches of one phrase.

In step S133, a subroutine for generating node pitches of the phrase in question (one phrase), which will be described later referring to FIG. 18, is executed, and step S134 is then executed to check the count value of the phrase counter, so as to determine whether the operation of step S133 has been performed for all of the phrases.

If step S134 determines that there is one or more phrases that have not been processed in step S133, step S135 is executed to increment the phrase counter by "1", and the control flow returns to step S133, to repeat the above-described operations. If no phrase remains unprocessed, step S136 is executed to determine whether the operation of step S133 has been performed with respect to all of the passages in the piece of music.

If step S136 determines that there is one or more passages that have not been processed, step S137 is executed to increment the passage counter by "1", and the control flow returns to step S132 to repeat the above-described operations. If no passage remains unprocessed, the control flow goes to step S138.

In step S138, the phrase pitch pattern as shown in FIG. 7 is displayed, and step S139 is then executed to give a performance of the phrase skeleton as described above. After execution of step S139, the node pitch generating operation for the phrase skeleton is finished.

FIG. 18 shows details of the subroutine of the above step S133 for generating node pitches of one phrase.

The present node pitch generating operation for one phrase is different from the node pitch generating operation for one passage of FIG. 14 only in that the passage is replaced by the phrase, and no substantial difference exists between the algorithms for these operations. Thus, no detailed description of the flow chart of FIG. 18 will be provided, and the manner of generating node pitches will be briefly described based on one example of node pitches generated for each phrase skeleton as shown in FIG. 24.

In FIG. 24, the first node pitch p111 of the first phrase of the first passage is determined as being identical with the node pitch p11 of FIG. 22 (that is identical with the node pitch p1 of FIG. 19) by the operation of step S141, and the last node pitch of the first phrase is then determined as being identical with the node pitch p12 of FIG. 22 by the operation of step S142. Since the first passage is a new passage in this example, the middle node pitches p112 and p113 of the first phrase are determined according to the algorithm represented by step S145, which is similar to that of step S85 of FIG. 14.

Similarly, the node pitches of the second phrase of the first passage are determined in the manner as described above, and the node pitches of each phrase of the remaining new passages, i.e., the third and fourth passages, are also determined in the manner as described above.

With regard to the second passage that is a first similar passage, the middle node pitches of each phrase, namely, node pitches other than the first and last node pitches, are determined according to the algorithm represented by steps S149 and S150, which is similar to that of steps S89 and S90 of FIG. 14.

As explained above, the automatic composition apparatus of the present embodiment is able to compose a piece of music, utilizing different layers of skeleton that constitute a hierarchical structure, namely, an overall skeleton, a passage skeleton based on the overall skeleton, and a phrase skeleton based on the passage skeleton. By initially determining the overall skeleton, and then determining the lower layers of skeleton for more details, the present apparatus is able to compose a piece of music while taking account of the structure of a melody as a whole. Also, the skeleton of the lower layer in the hierarchical structure is constructed based on that of the higher layer, and therefore only the skeleton of the lower layer can be changed without changing the skeleton of the higher layer.

Furthermore, each type of skeleton showing specific pitches is displayed in graphics, thus enabling the user to visually grasp specific changes in the pitches of the melody generated by the apparatus. Also, since the skeleton is displayed for each layer of the hierarchical structure, the user is able to know general and/or local changes of pitches at a glance. Moreover, a plurality of layers of skeletons may be displayed in a superposed form using different display modes, which makes even easier for the user to know general and/or local changes of pitches.

In addition, the present apparatus is provided with a function of playing only the notes contained in the skeleton, and thus the user is able to immediately evaluate the melody thus generated.

While the hierarchical structure consists of three layers of skeletons, i.e., "overall", "passage" and "phrase", in the present embodiment, it may consist of two, or four or more layers of skeletons. It is also to be noted that the names of the respective layers are not limited to "overall", "passage", and "phrase". While the node pitches are taken at two points per passage, or phrase, or measure, i.e., the first and last nodes in each passage, or phrase, or measure, in the illustrated embodiment, the node pitches may be taken at three or more points. Also, middle tone-generating points in each passage, phrase, or measure may be taken as nodes.

It is also to be understood that the algorithms used for generating node pitches are not limited to those as described above. Since the present invention is not characterized by algorithms based on which pitches and rhythm pattern other than node pitches are determined, and such algorithms are not mentioned in the illustrated embodiment, any algorithm may be employed for determining pitches or rhythm pattern. In the illustrated embodiment, each skeleton is generated by modifying a melody template retrieved from the melody template database 32. The present invention is not limited to this arrangement, but may permit the user to create each skeleton from the beginning. While the conditions that can be set by the user include "dynamics", "tone range", "first pitch of a piece of music", and "the last pitch of a piece of music", for illustrative purpose only, other conditions may also be established.

The structure of a piece of music does not necessarily consist of the same and similar passages, but may consist of the same and similar phrases or measures.

In addition, the skeleton may be modified by manual operations (for example, by dragging a mouse). In this case, too, only the skeleton of a desired layer may be modified without modifying the skeleton(s) of the upper layer(s). For example, the passage skeleton may be modified without modifying the overall skeleton. Also, the skeleton of a lower layer may be automatically modified or nullified in accordance with modification of the skeleton of a desired upper layer. For example, the phrase skeleton may be automatically modified or nullified in accordance with modification of the passage skeleton. In the case where the skeleton is modified by a manual operation, so as to modify sections including the same-name and/or similar passages, it is desirable to modify the other sections so as to maintain the identity or similarity of these passages.

While skeleton data contained in a template retrieved from a database is suitably modified as needed in the illustrated embodiment, it is also possible to arithmetically create skeleton data from the beginning, without using such a template of the database. In this case, the skeleton data modifying operations as described above may be utilized for creating skeleton data.

It is to be understood that the object of the present invention may also be accomplished by supplying a system or an apparatus with a storage medium in which a software program that realizes the functions of the illustrated embodiment is recorded, and causing a computer (CPU 5 or MPU) of the system or apparatus to read out and execute the program stored in the storage medium.

In this case, the program itself read from the storage medium accomplishes the novel functions of the present invention, and thus the storage medium storing the program constitutes the present invention.

The storage medium for supplying the above-described program to the system or apparatus may be selected from a hard disc mounted in the HDD 11, CD-ROM 21, MO, MD, floppy disc 20, CD-R (CD-Recordable), magnetic tape, non-volatile memory card, ROM, and others. The program may also be supplied from other MIDI equipment 100, or the server computer 102 via the communication network 101.

The functions of the illustrated embodiment may be accomplished not only by executing a program read by a computer, but also by causing an operating system (OS) that operates on the computer, to perform a part or the whole of the actual operations according to instructions of the program.

Furthermore, the program read from the storage medium may be written into a memory provided in an expanded board inserted in the computer, or an expanded unit connected to the computer, and a CPU, or the like, provided in the expanded board or expanded unit may actually perform part or all of the operations according to the instructions of the program, so as to accomplish the functions of the illustrated embodiment.

According to the present invention as explained above, when a melody skeleton corresponding to one of a plurality of layers in a hierarchical structure is generated, and if there exists a higher layer of skeleton than the above-indicated one layer of melody skeleton to be generated, the melody skeleton of the one layer is generated based on that of the higher layer. Where a piece of music is constructed by a hierarchical structure consisting of an overall skeleton, a passage skeleton, and a phrase skeleton, for example, the overall skeleton is initially determined, and more detailed skeletons of the lower layers are determined based on the overall skeleton, so that the piece of music can be composed taking account of the structure of the melody as a whole.

In a preferred form of the invention, each of a plurality of sequential regions of a predetermined category is set to one of a new musical component, the same musical component that is identical with a musical component set in a preceding one of the sequential regions, and a similar musical component that is similar to a musical component set in a preceding one of the sequential regions, and the melody skeleton of the region set to the same or similar musical component is generated based on the skeleton of the preceding one of the sequential regions. With this arrangement, the desired piece of music can be composed in accordance with the preset structure of the piece of music with ease.

In a further preferred form of the invention, when a melody skeleton of a certain layer is generated in the presence of a higher layer of skeleton than that of the layer in question, only the melody skeleton of the layer in question may be modified without adding any changes to the higher layer of skeleton. Thus, only the lower layer of skeleton can be modified while maintaining the higher layer of skeleton as it is.

The apparatus of the present invention is adapted to display the melody skeleton of each layer generated in the manner as described above, thus enabling the user to visually grasp changes of pitches over the whole piece of music.

Also, the present apparatus plays back the melody skeleton of each layer generated in the manner as described above, thus enabling the user to immediately evaluate the melody of the piece of music that is being composed.

What is claimed is:

1. An automatic composition apparatus comprising:

a generating device that generates each of a plurality of layers of skeleton that constitutes a melody of a piece of music, said plurality of layers forming a hierarchical structure, wherein said generating device generates each layer of skeleton except the highest layer of skeleton, based on at least one of said plurality of layers of skeleton that is higher than said each layer of skeleton.

2. An automatic composition apparatus comprising:

a generating device that generates each of a plurality of layers of skeleton that constitutes a melody of a piece of music, said plurality of layers forming a hierarchical structure, wherein said generating device generates each layer of skeleton except the highest layer of skeleton among said plurality of layers of skeleton, by modifying only said each layer of skeleton without modifying at least one of the plurality of layers of skeleton that is higher than said each layer.

3. An automatic composition apparatus comprising:

a generating device that generates each of a plurality of layers of skeleton that constitutes a melody of a piece of music, said plurality of layers forming a hierarchical structure, wherein said generating device first generates the highest layer of skeleton among said plurality of layers of skeleton, and then generates each of at least one other layer of skeleton other than the highest layer of skeleton, based on at least one of said plurality of layers of skeleton that is higher than said each of at least one other layer of skeleton.

4. An automatic composition apparatus according to claim 1, wherein said plurality of layers of skeleton comprise a layer of an overall skeleton, a layer of an passage skeleton based on said overall skeleton, and a phrase skeleton based on said passage skeleton.

5. An automatic composition apparatus according to claim 2, wherein said plurality of layers of skeleton comprise a layer of an overall skeleton, a layer of an passage skeleton based on said overall skeleton, and a phrase skeleton based on said passage skeleton.

6. An automatic composition apparatus according to claim 3, wherein said plurality of layers of skeleton comprise a layer of an overall skeleton, a layer of an passage skeleton based on said overall skeleton, and a phrase skeleton based on said passage skeleton.

7. An automatic composition apparatus comprising:

a generating device that generates each of a plurality of layers of skeleton that constitutes a melody of a piece of music, said plurality of layers forming a hierarchical structure; and a display device that displays said plurality of layers of skeleton generated by said generating device, at the same time.

8. An automatic composition apparatus comprising:

a generating device that generates each of a plurality of layers of skeleton that constitutes a melody of a piece of music, said plurality of layers forming a hierarchical structure; and a playback device that plays a selected one of said plurality of layers of skeleton generated by said generating device.

9. An automatic composition apparatus comprising:

a generating device that generates a skeleton that constitutes a melody of a piece of music; and a setting device that divides the piece of music into a plurality of sequential regions of a predetermined category, and sets each of the regions to one of a new musical component, the same musical component that is identical with a musical component set in a preceding one of the plurality of sequential regions, and a similar musical component that is similar to a musical component set in a preceding one of the plurality of sequential regions;

wherein said generating device generates a skeleton of the region set to the same or similar musical component by said setting device, based on a skeleton of said preceding one of the plurality of sequential regions.

10. An automatic composition apparatus according to claim 9, wherein said generating device generates the skeleton of the region set to the same musical component by said setting device, that is the same as the skeleton of said preceding one of the plurality of sequential regions.

11. An automatic composition apparatus according to claim 9, wherein said generating device generates the skeleton of the region set to the similar musical component by said setting device, that has only a portion thereof identical with the skeleton of said preceding one of the plurality of sequential regions.

12. An automatic composition apparatus according to claim 11, wherein said generating device generates a portion of the skeleton of the region set to the similar musical component by said setting device other than the portion of the skeleton that is identical with the skeleton of said preceding one of the plurality of sequential regions, using at least one of constituent notes of a given chord.

13. An automatic composition apparatus according to claim 9, wherein said generating device generates the skeleton of the region set to the new musical component, using at least one of constituent notes of a given chord.

14. A method of automatically composing a piece of music, comprising a step of:

generating each of a plurality of layers of skeleton that constitutes a melody of a piece of music, said plurality of layers forming a hierarchical structure, wherein each layer of skeleton except the highest layer of skeleton is generated based on at least one of said plurality of layers of skeleton that is higher than said each layer of skeleton.

15. A method of automatically composing a piece of music, comprising a step of:

generating each of a plurality of layers of skeleton that constitutes a melody of a piece of music, said plurality of layers forming a hierarchical structure, wherein each layer of skeleton except the highest layer of skeleton among said plurality of layers of skeleton is generated by modifying only said each layer of skeleton without modifying at least one of the plurality of layers of skeleton that is higher than said each layer.

16. A method of automatically composing a piece of music, comprising a step of:

generating each of a plurality of layers of skeleton that constitutes a melody of a piece of music, said plurality of layers forming a hierarchical structure, wherein the highest layer of skeleton among said plurality of layers of skeleton is first generated, and then each of at least one other layer of skeleton other than the highest layer of skeleton is generated based on at least one of said plurality of layers of skeleton that is higher than said each of at least one other layer of skeleton.

17. A method of automatically composing a piece of music, comprising steps of:

generating each of a plurality of layers of skeleton that constitutes a melody of a piece of music, said plurality of layers forming a hierarchical structure; and displaying said plurality of layers of skeleton generated by said generating step, at the same time.

18. A method of automatically composing a piece of music, comprising steps of:

generating each of a plurality of layers of skeleton that constitutes a melody of a piece of music, said plurality of layers forming a hierarchical structure; and playing a selected one of said plurality of layers of skeleton generated by said generating step.

19. A method of automatically composing a piece of music, comprising steps of:

generating a skeleton that constitutes a melody of a piece of music;

dividing the piece of music into a plurality of sequential regions of a predetermined category; and setting each of the regions to one of a new musical component, the same musical component that is identical with a musical component set in a preceding one of the plurality of sequential regions, and a similar musical component that is similar to a musical component set in a preceding one of the plurality of sequential regions;

wherein a skeleton of the region set to the same or similar musical component by said setting step is generated based on a skeleton of said preceding one of the plurality of sequential regions.

20. A storage medium storing an automatic composition program that is executable by a computer, said program comprising:

a generating module that generates each of a plurality of layers of skeleton that constitutes a melody of a piece of music, said plurality of layers forming a hierarchical structure, wherein said generating module generates each layer of skeleton except the highest layer of skeleton, based on at least one of said plurality of layers of skeleton that is higher than said each layer of skeleton.

21. A storage medium storing an automatic composition program that is executable by a computer, said program comprising:

a generating module that generates each of a plurality of layers of skeleton that constitutes a melody of a piece of music, said plurality of layers forming a hierarchical structure, wherein each layer of skeleton except the highest layer of skeleton among said plurality of layers of skeleton is generated by modifying only said each layer of skeleton without modifying at least one of the plurality of layers of skeleton that is higher than said each layer.

22. A storage medium storing an automatic composition program that is executable by a computer, said program comprising:

a generating module that generates each of a plurality of layers of skeleton that constitutes a melody of a piece of music, said plurality of layers forming a hierarchical structure, wherein the highest layer of skeleton among said plurality of layers of skeleton is first generated, and then each of at least one other layer of skeleton other than the highest layer of skeleton is generated based on at least one of said plurality of layers of skeleton that is higher than said each of at least one other layer of skeleton.

23. A storage medium storing an automatic composition program that is executable by a computer, said program comprising:

a generating module that generates each of a plurality of layers of skeleton that constitutes a melody of a piece of music, said plurality of layers forming a hierarchical structure; and a display module that displays said plurality of layers of skeleton generated by said generating module, at the same time.

24. A storage medium storing an automatic composition program that is executable by a computer, said program comprising:

a generating module that generates each of a plurality of layers of skeleton that constitutes a melody of a piece of music, said plurality of layers forming a hierarchical structure; and a playback module that plays a selected one of said plurality of layers of skeleton generated by said generating module.

25. A storage medium storing an automatic composition program that is executable by a computer, said program comprising:

a generating module that generates a skeleton that constitutes a melody of a piece of music;

a dividing module that divides the piece of music into a plurality of sequential regions of a predetermined category; and a setting module that sets each of the regions to one of a new musical component, the same musical component that is identical with a musical component set in a preceding one of the plurality of sequential regions, and a similar musical component that is similar to a musical component set in a preceding one of the plurality of sequential regions;

wherein a skeleton of the region set to the same or similar musical component by said setting module is generated based on a skeleton of said preceding one of the plurality of sequential regions.

* * * * *